United States Patent [19]

Kubo et al.

[11] 4,120,260

[45] Oct. 17, 1978

[54] APPARATUS FOR APPLYING REFRACTORY MATERIAL ONTO THE INNER SURFACE OF A FURNACE

[75] Inventors: Sueki Kubo; Toshiro Watanabe; Masayuki Fujita; Tadahiko Matsuno, all of Kitakyushu; Akira Morita, Ibaragi, all of Japan

[73] Assignee: Kurosaki Refractories Co., Ltd., Fukuoka, Japan

[21] Appl. No.: 788,941

[22] Filed: Apr. 19, 1977

[30] Foreign Application Priority Data

| | | | |
|---|---|---|---|
| Apr. 19, 1976 | [JP] | Japan | 51/44759 |
| Nov. 12, 1976 | [JP] | Japan | 51/136733 |
| Nov. 16, 1976 | [JP] | Japan | 51/154018[U] |
| Nov. 24, 1976 | [JP] | Japan | 51/141422 |
| Dec. 1, 1976 | [JP] | Japan | 51/161518[U] |
| Dec. 3, 1976 | [JP] | Japan | 51/145757 |
| Dec. 3, 1976 | [JP] | Japan | 51/162941 |
| Dec. 8, 1976 | [JP] | Japan | 51-148048 |
| Dec. 23, 1976 | [JP] | Japan | 51-173401 |
| Jan. 20, 1977 | [JP] | Japan | 52-6182 |
| Feb. 7, 1977 | [JP] | Japan | 52-12679 |
| Feb. 15, 1977 | [JP] | Japan | 52-17727 |
| Mar. 28, 1977 | [JP] | Japan | 52-38147 |

[51] Int. Cl.[2] ..... B05B 13/06

[52] U.S. Cl. ..... 118/317; 239/132.3; 239/172; 239/187; 427/236

[58] Field of Search ..... 118/317, 306, 318; 427/181, 236; 239/132.3, 165, 166, 172, 176, 187, 264, 227

[56] References Cited

U.S. PATENT DOCUMENTS

| | | | |
|---|---|---|---|
| 3,351,289 | 11/1967 | Demaison | 239/187 |
| 3,439,911 | 4/1969 | Barnard et al. | 239/132.3 X |
| 3,473,737 | 10/1969 | Bowman | 239/187 |
| 3,827,633 | 8/1974 | Kouno etal. | 239/187 |
| 3,917,170 | 11/1975 | Marino | 118/317 |
| 3,957,203 | 5/1976 | Bullard | 118/317 |

*Primary Examiner*—Mervin Stein
*Attorney, Agent, or Firm*—Frank J. Jordan

[57] ABSTRACT

In an apparatus of this invention which applies refractory material in either wet or dry form onto the inner surface of a furnace, the improvement is characterized in that all the devices inevitable for the lining operation including an operator's seat are effectively mounted on the transport car thereof which can be steered readily in any direction around the furnace.

Due to the above construction, the lining apparatus of this invention can conduct the spraying operation with great mobility and reliability.

28 Claims, 59 Drawing Figures

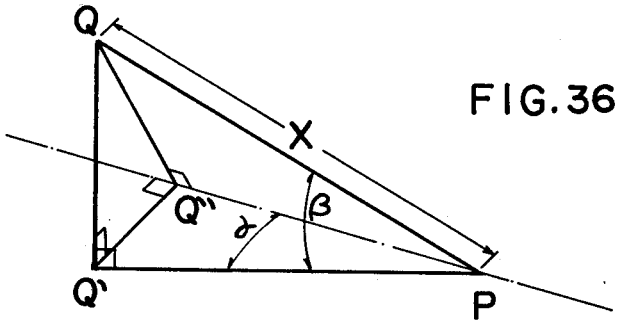
FIG. 36
FIG. 37
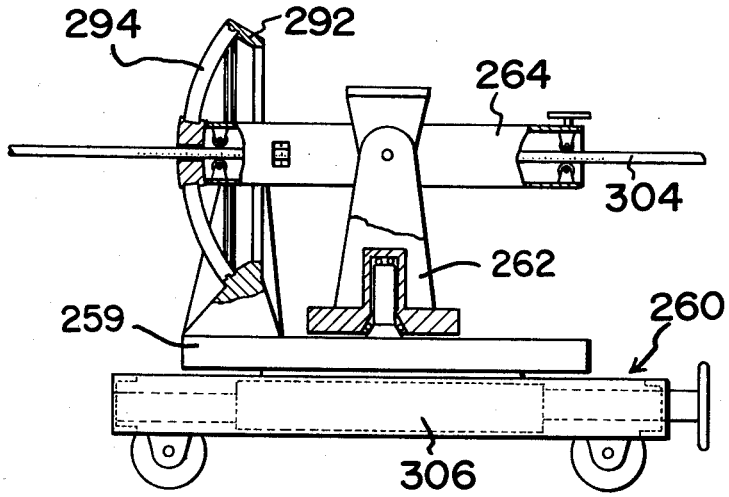

APPARATUS FOR APPLYING REFRACTORY MATERIAL ONTO THE INNER SURFACE OF A FURNACE

BACKGROUND OF THE INVENTION

This invention relates to an apparatus for applying a lining of refractory material, cement, heat-insulating material or other insulating materials over the refractory layers of a converter or a furnace including electric furnace and open-hearth or a vessel with great mobility.

In conventional lining operations, the lining material is generally produced at a location remote from the lining operation site and then is transferred to the operation site by means of a long compression supply tube wherein the long floor-laid tube hampers the movement of the lining device when it must move from one converter to another, resulting in an inefficient lining operation.

Furthermore, since the water storage tank, refractory material tank, compressor and the like which are required in the lining operation occupy a large floor area, the operation cannot be conducted efficiently or with adequate mobility.

In addition, these devices are usually located in spaced apart locations so that a central control system for the spraying apparatus is hard to achieve. Therefore, at least several workers are required to operate the apparatus.

Meanwhile, in the lining operation, the lining apparatus is moved to a position adjacent to the upper open end of the furnace. Subsequently, the long spray pipe is extended into the furnace and the spray nozzle attached to the extremity of the spray pipe is directed toward the abraded or eroded portion of the furnace lining and the desired amount of refractory material is sprayed onto the above portion so as to repair the lining of a furnace.

In this case, the operator controls the spray pipe while observing the movement thereof.

However, the mere manipulation of the spray pipe is often inadequate to insure coverage of all of the abraded portions on the furnace lining because they are not all within the sprayable range of the spray pipe.

For example, as shown in FIG. 59, when the spray nozzle is directed from one abraded portion to another, in some cases the spray pipe will come into contact with the upper periphery of the furnace if the lining apparatus is kept in the same position. In these cases, the apparatus as a whole must be moved a certain distance to prevent breaking the spray pipe. The operation to move the apparatus conventionally requires that the operator get off the apparatus or shift his position on the apparatus thereby making the operation very cumbersome.

Accordingly, it is an object of the present invention to provide an apparatus for applying a lining onto the inner surface of a furnace which overcomes the aforementioned disadvantages and which is capable of conducting the lining operation with great mobility.

It is another object of the present invention to provide an apparatus for applying a lining onto the inner surface of a furnace wherein all the required devices for the spraying operation are mounted on the transport car of the apparatus so that the apparatus becomes extremely compact, requiring little operating space.

It is still another object of the present invention to provide an apparatus for applying a lining onto the inner surface of a furnace and includes a central control system with which an operator can manipulate all the devices mounted on the transport car easily and precisely.

It is still another object of the present invention to provide an apparatus for repairing the lining of a furnace by means of which the entire spraying operation including the manipulation of the spray pipe as well as the steering of the transport car can be conducted by a single operator while sitting on the seat mounted on the apparatus throughout the spraying operation.

The lining apparatus of this invention which is particularly useful in repairing the lining of a converter furnace, an open-hearth furnace or the like is substantially constructed as follows.

The steering seat on which an operator sits to control the spray pipe as well as the lining device per se is fixedly secured to a rotatable means on a turntable mounted on the lining car.

A lining device for facilitating the operation to repair the furnace lining is mounted on a transport car. The power-supply devices, such as the internal combustion engine and compressors, are also mounted on the transport car to activate the lining device and move the spray pipe as well as the transport car. The lining device substantially comprises a turntable which is mounted on the transport car and is capable of turning approximately 360°, a double storage tank arrangement which consists of a tank for storing the powder-like material and a tank for storing water, a spray pipe of a telescopic construction which is moved away from or toward the inside of a furnace and a steering seat which may be secured to either the refractory material storage tank or to the water storage tank.

To be more specific, the spray pipe consists of inner and outer spray pipes, the outer shooting pipe being rotatably supported by and within a guide (cylindrical) body which, in turn, is tiltably mounted on the top of a vertical support column fixedly mounted on the transport car.

A gear mechanism is provided between the support column and the cylindrical body which facilitates the approximately fuli-turn rotation of the spray pipe relative to the cylindrical body.

A tilting means such as a hydraulic cylinder is disposed between the cylindrical body and the turntable such that the tilting means causes the rocking movement of the spray pipe with the top end of the support column serving as the fulcrum.

Furthermore, the spray pipe may comprise inner and outer concentric pipes and a first pipe-propelling means and a second pipe-propelling means wherein the former means causes the sliding movement of the inner spray pipe relative to the outer spray pipe and the latter means causes the sliding movement of the outer spray pipe relative to the cylindrical body. The spray pipe is connected with the refractory-material storage tank and the water storage tank by means of a flexible hose. The above-mentioned steering seat is provided with a control panel which enables control of the lining device.

Corresponding to the rotation of the turntable, the steering seat is rotated together with the refractory material storage tank as well as the water storage tank and can change its position relative to the transport car while the transport car is moving.

The apparatus with the above construction conducts the operation to repair the furnace as follows:

An operator seated in the steering seat moves and steers the apparatus on which the water and refractory-material storage tanks are mounted, to a desired position adjacent to a furnace. Subsequently, by manipulating the control panel near the steering seat, the turntable is rotated until the spray pipe is directed toward the tapping opening of the furnace. The spray pipe is then extended into the furnace and is tilted by tilting means, rotated by rotating means or turned by the turntable so as to direct the spray nozzle attached to the extremity thereof to an abraded or eroded portion of the furnace lining for application of the refractory material thereto.

The refractory material in either dry or wet slurry form is supplied into the spray pipe and the thus charged refractory material is sprayed from the spray nozzle and is applied onto the above-mentioned portion of the furnace lining which requires repair.

In a dry spraying operation, the water is added to the refractory material at any place between the storage tank and the spray nozzle while in wet spraying operation, the refractory material in wet slurry form is stored in the storage tank from the beginning and the intermediate water supply is unnecessary.

In this way, the apparatus of this invention is most effectively operable when the spray pipe (the spray nozzle) must be shifted from one abraded portion to another after completing the repair of the former portion. Namely, refering to FIG. 59, when the second abraded portion is to be repaired after the repair of the first abraded portion, mere rotation of the shooting pipe will not prevent it from contacting the peripheral opening of the furnace. However, since the lining apparatus is provided with the above-described construction, the operator seated in the steering seat can move the transport car in the desired direction while simultaneously manipulating the spray pipe so that the refractory material can be readily applied to all the abraded portions of the furnace lining, resulting in a highly effective repair operation.

BRIEF DESCRIPTION OF THE DRAWINGS

FIG. 36 is another explanatory view showing the relationship between the rotating angle ($\alpha$), tilting angle ($\beta$) and the slide length (X) of spray pipe.

FIG. 37 is a side view of a modified measuring car of FIG. 32.

DETAILED DESCRIPTION OF THE INVENTION

FIRST EMBODIMENT

Figure 1:
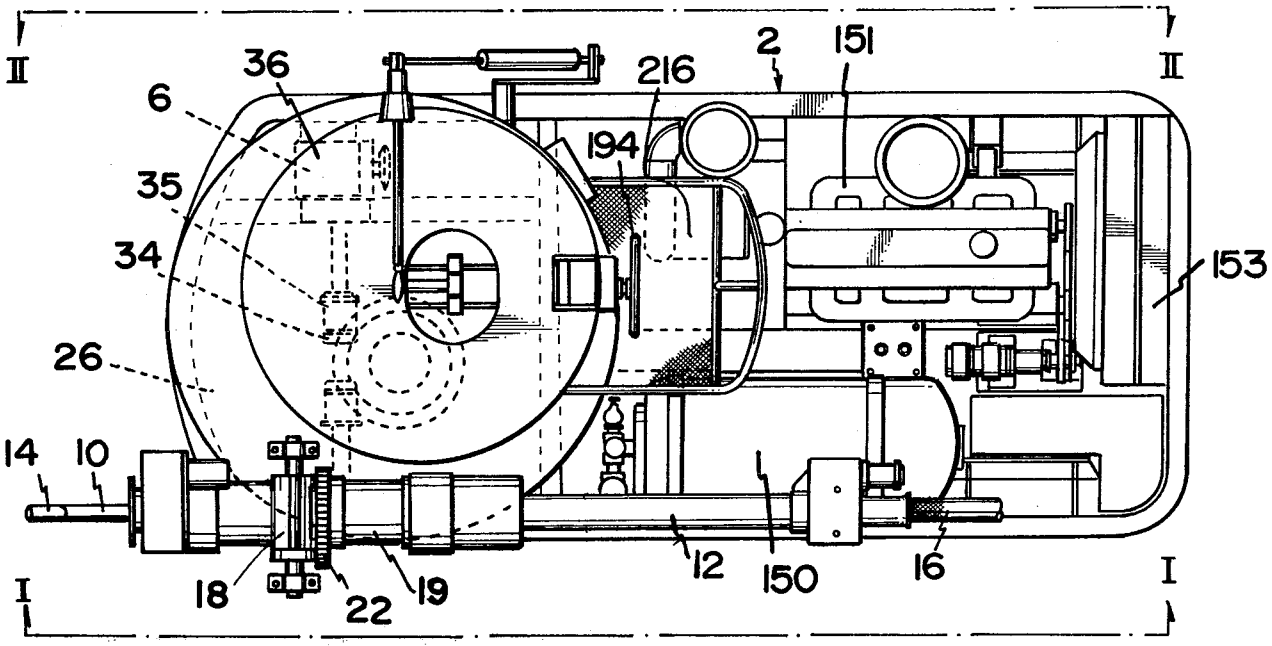
FIG. 1 is a top plan view of the apparatus of the first embodiment of this invention.
Figure 2:
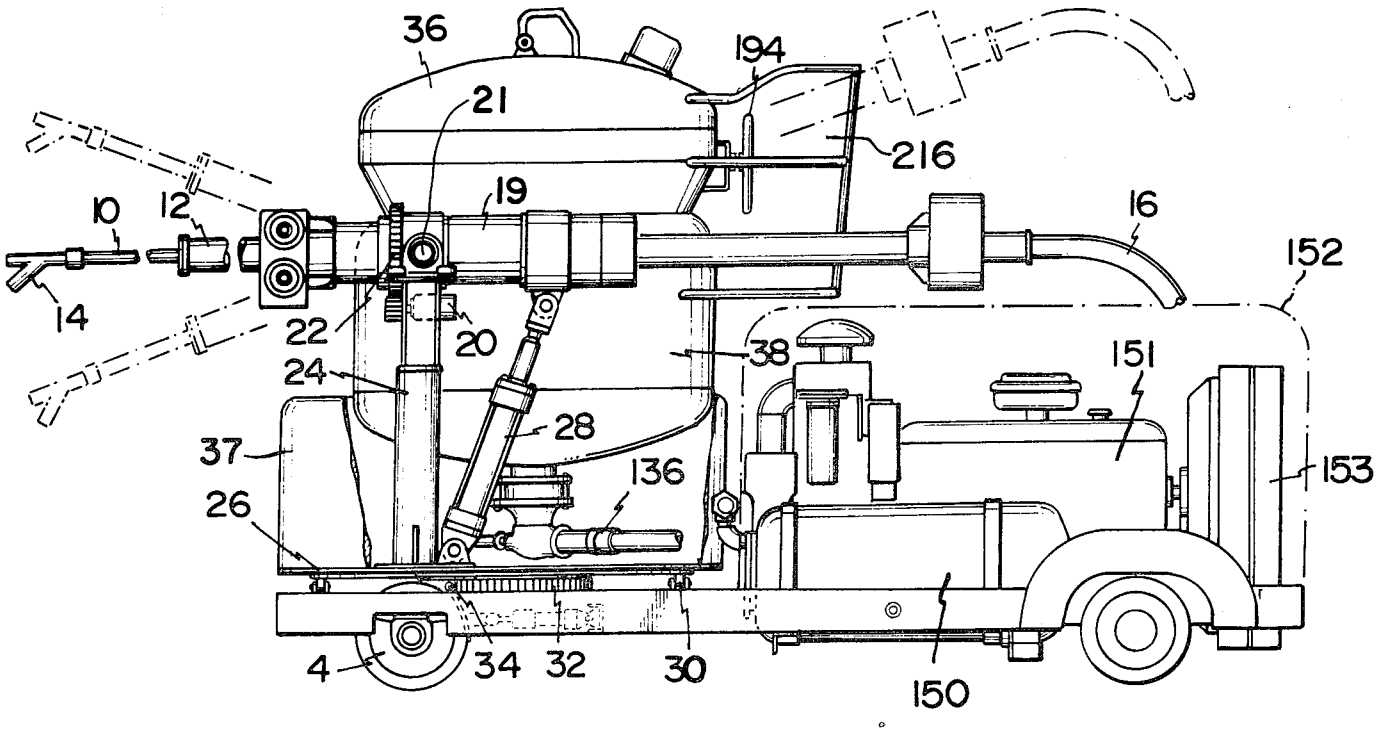
FIG. 2 is a side view taken along the line I—I of FIG. 1.
Figure 3:
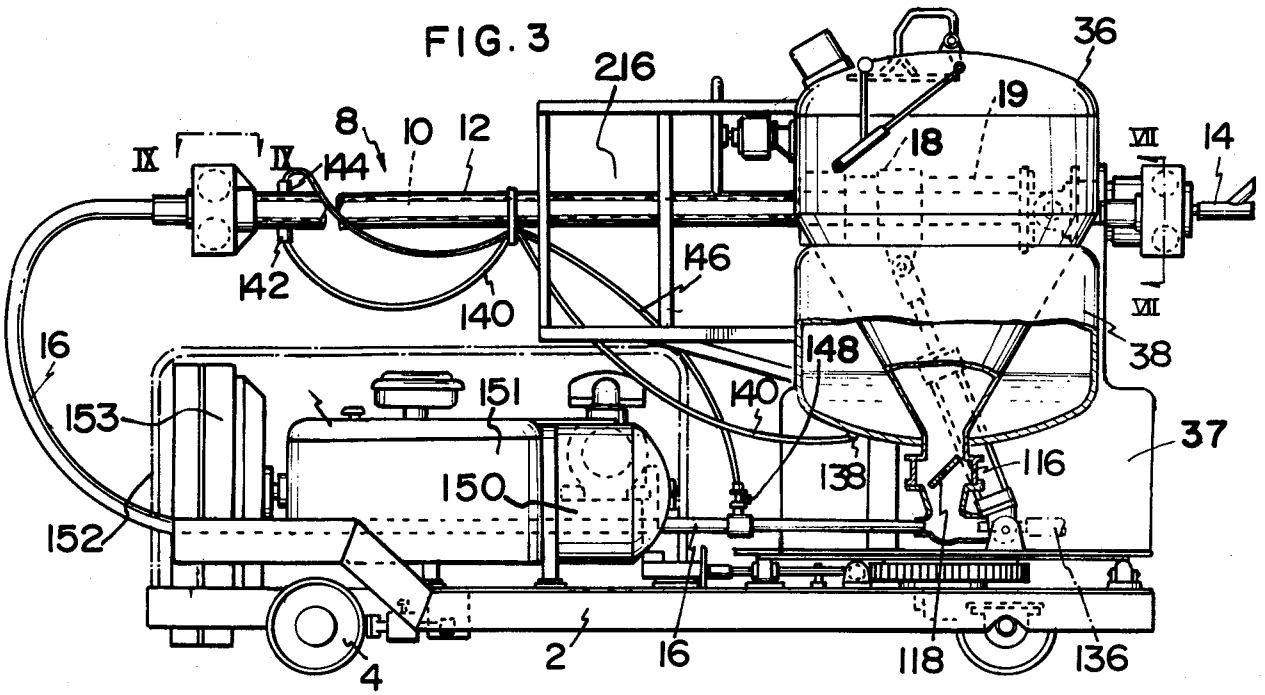
FIG. 3 is another side view partially broken away and taken along line II—II of FIG. 1.
Figure 4:
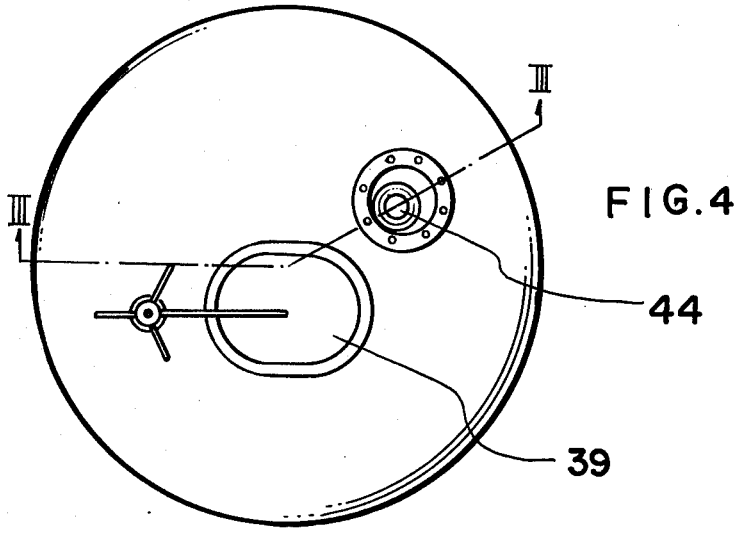
FIG. 4 is a top plan view of the storage tank of the apparatus showing especially the refractory material agitating means mounted therein.
Figure 5:
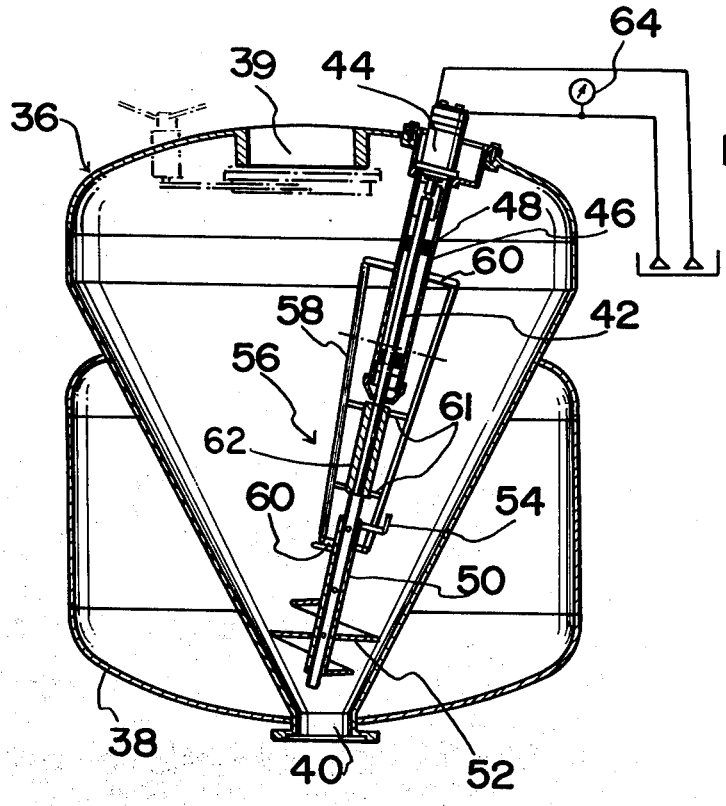
FIG. 5 is a longitudinal cross sectional view of the storage tank taken along the line III—III of FIG. 4.
Figure 6:
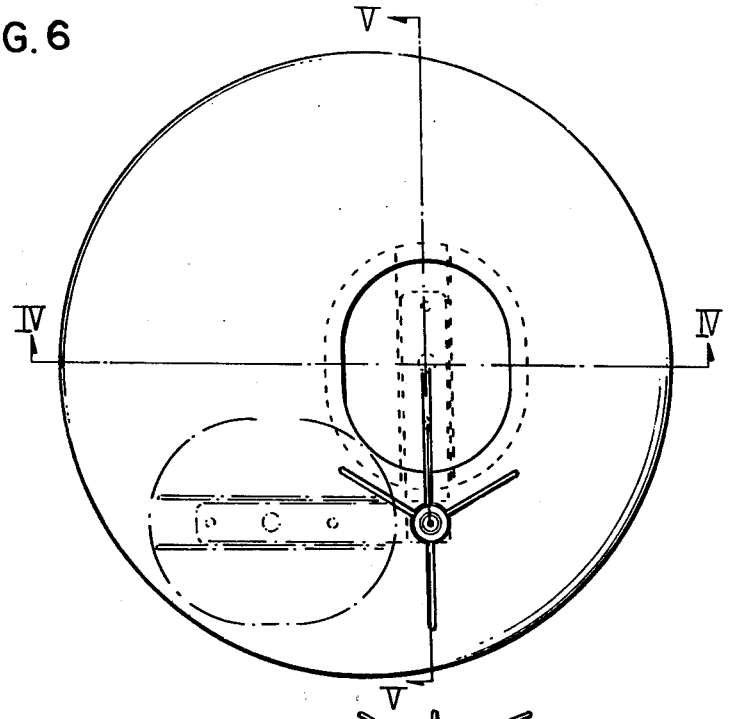
FIG. 6 is a plan view of the storage tank shown in FIGS. 4 and 5 showing especially the lid means mounted thereon.
Figure 7:
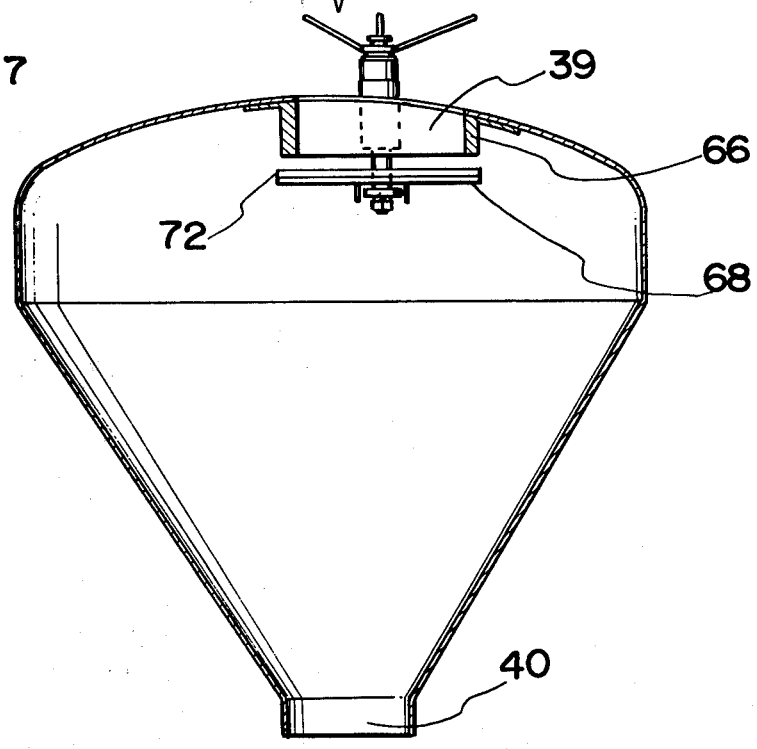
FIG. 7 is a longitudinal cross sectional view of the storage tank taken along the line IV—IV of FIG. 6.
Figure 8:
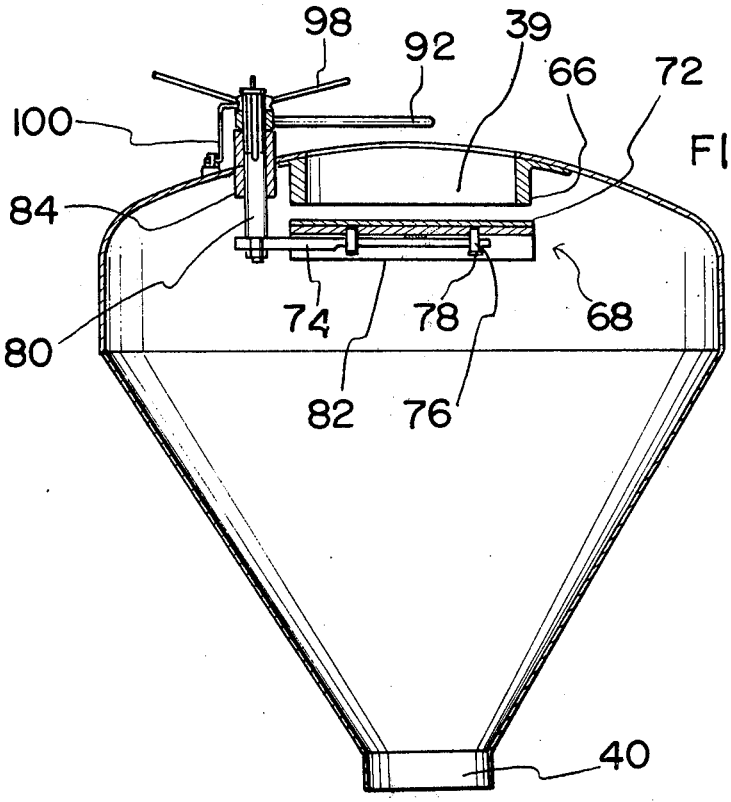
FIG. 8 is another longitudinal cross-sectional view of the storage tank taken along the line V—V of FIG. 6.
Figure 9:
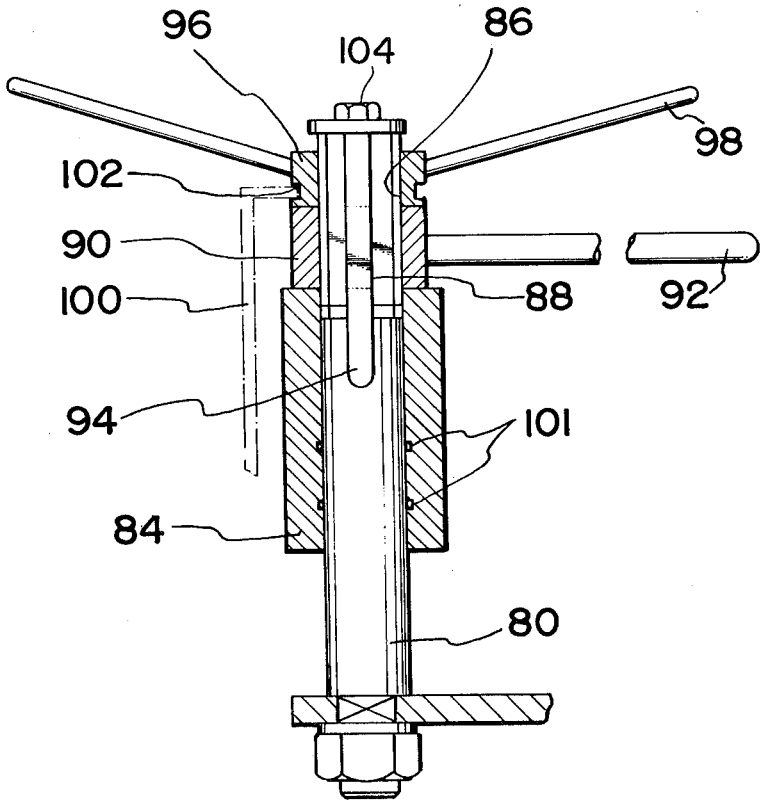
FIG. 9 is an enlarged cross-sectional view of the lid means for the storage tank showing especially the mechanism to open the lid means.

The apparatus for repairing a furnace lining is described in accordance with the following embodiments. The first embodiment discloses the basic structure of the lining apparatus of this invention. Referring to FIG. 1 through FIG. 3, there is shown a transport car 2 provided with wheels 4 driven by hydraulically-operated motors so that the car 2 is movable both backwards and forwards. Above and substantially parallel to the transport car 2, there is shown a spray pipe 8 consisting of an inner pipe 10 and an outer pipe 12.

The inner spray pipe 10 is provided with a spray nozzle 14 at the front extremity thereof and has the rear end thereof tightly connected with one end of a flexible hose 16 through which refractory material in either dry or wet form is supplied thereto.

The other end of the flexible hose 16 is connected to a refractory material supply source which is described later. The inner spray pipe 10 is slidably disposed inside the outer spray pipe 12 such that spray pipe 8 as a whole can be extended in a telescopic manner while the outer spray pipe 12 is rotatably and slidably disposed within a cylindrical member or body 18 which is disposed substantially at the front of the transport car 2. A power-operated motor 20 and a gear mechanism 22 which are both attached to the cylindrical body 18 cause the rotation of the outer spray pipe 12 by way of a rotating boom 19. The rotating boom 19 forms a part of the cylindrical body 18.

This cylindrical body 18 is tiltably mounted by means of a pivot shaft 21 on the top of a vertical support structure 24 which in turn has the bottom end fixedly secured to the upper surface of a turntable 26. A hydraulic cylinder 28 is diagonally disposed on the turntable 26 for the purpose of tilting the cylindrical body 18. This turntable 26 is supported by a plurality of roller means 30 which are disposed in a circle at the lower periphery of the turntable 26.

The turntable 26 further includes a worm wheel 32 which meshes with a worm 34. The worm 34 is driven by a suitable driving means 35, such as a power-operated motor, so as to rotate the turntable 26 by way of the worm wheel 32.

On the turntable 26, a storage tank 36 for powder-like refractory material and another storage tank 38 for water are mounted by means of support columns 37 such that the vertical axes of the tanks are aligned with the axis of the turntable 26. These tanks 36 and 38 are concentrically disposed one within the other such that the discharge outlet of the conical-shaped refractory material tank 36 is disposed just below the center of the bottom of the water storage tank 38.

The construction of the tanks, especially of the refractory material storage tank 36, is hereinafter described in detail with reference to FIG. 4 through FIG. 11.

The storage tank 36, which is usually subject to a predetermined internal pressure, has a charging inlet 39 at the top thereof and a discharge outlet 40 at the bottom thereof. Within the tank 36, a vertical rotary shaft 42 is disposed in a slightly inclined position with the upper end thereof fixedly connected to a rotating device 44 such as a hydraulic motor which, in turn, is mounted at the top of the storage tank 36. The hydraulic motor 44 rotates the rotary shaft 42 at a constant speed or velocity. The upper half portion of the rotary shaft 42 is kept air-tight by a hollow sleeve 46 which is concentrically disposed over the rotary shaft 42 whereby the rotary shaft 42 is rotated relative to the hollow sleeve 46 due to bearings 48 disposed at both ends of the sleeve 46.

A hollow tube 50, which is provided with a fixed helicoid blade 52 on the outer periphery thereof, is mounted on the lower portion of the rotary shaft 42 below the lower end of the sleeve 46. The lower end of the rotary shaft 42 is directed toward the discharge outlet 40 of the storage tank 36. The hollow tube 50 has a crusher bar 54 attached at the upper end thereof which prevents the formation of a refractory material bridge within the storage tank.

The rotary shaft 42 is further provided with an axially extending resistance structure 56 which is substantially made of two axial bars 58, semi-circular top and bottom end connecting bars 60 connected to the axial bars 58 a hollow shaft 62 secured to the rotary shaft 42, and intermediate bars 61 which connect the bars 58 to the hollow shaft.

In the above construction, a pressure gauge 64 is connected to the middle of the hydraulic motor 44 and this gauge 64 indicates the change in the resistance pressure received by the resistance structure 56. In other words, the pressure gauge 64 is used to indicate the amount of refractory material within the tank 36 by measuring the pressure resistance.

When an electrically powered motor is used as the rotating device 44, the change in resistance can be indicated as a change in either electric current or voltage and the amount of refractory material within the tank 36 can be measured as in the case of the pressure gauge 64.

Due to the above construction, when the rotary shaft 42 and the corresponding helicoid blade 52 are rotated, the downward movement of the refractory material adjacent to the discharge outlet 40 of the storage tank 36 is accelerated by the helicoid blade section whereby the arching or bridging phenomenon which prevents the smooth discharge of the refractory material can be avoided.

Furthermore, since the resistance structure 56 which is disposed around and along the axis of the rotary shaft 42 is attached to the rotary shaft 42, the resistance structure 56 is rotated against the resistance of the refractory material contained in the storage tank 36. Thus, when the tank 36 contains a substantial amount of refractory material therein, the resistance structure 56 has its entire surface subject to the resistance of refractory material so that the load that the hydraulic motor 44 receives by way of the resistance structure shows a high value. When the amount of refractory material in the tank 36 is decreased the load shows a low value.

Since the hydraulic motor is of a constant-volume-type and therefore always rotates at a constant speed, the change in the load can be indicated as a change in pressure and an indication as to the quantity of refractory material within the tank.

Accordingly, if the readings of the pressure gauge 64 are predetermined such that they correspond to the changes in the load of the hydraulic actuator, the amount of refractory material within the tank 36 can be determined easily.

Therefore, due to the above construction, the refractory material can be distributed constantly and the amount of refractory material in the tank 36 can be determined precisely thereby eliminating the necessity of checking the amount of refractory material within the storage tank and thereby enabling one to anticipate an interruption in the lining operation such as may occur when the tank 36 is emptied of refractory material.

The storage tank 36 for refractory material is further provided with a specially-devised lid means which horizontally opens or closes the inlet for selectively charging refractory material.

Around the periphery of the charging inlet 39, a ring seat 66 is attached, and lid means 68 is adapted to move towards or away from the bottom surface of the ring seat 66. The lid 68 has a packing 72 on the entire upper surface thereof while the lid 68 has its lower end secured to a supporting arm 74 by fastening pins 76 and snap rings 78. The proximal end of the supporting arm 74 is fixedly connected to the lower end of a vertical support shaft 80 which is disposed vertically at the periphery of the charging inlet 39.

Furthermore, a center-pressing means 82 which urgingly presses against the lower central portion of the lid 68 is disposed between the supporting arm 74 and the lid 68.

The vertical support shaft 80 is elevatable and rotatable within a longitudinal sleeve 84 which is secured to the upper portion of the storage tank 36. To enable the above movement of the shaft 80 relative to the sleeve 84, the upper portion of the support shaft 80 is formed with a thread 86 and also with a longitudinal slit 88. The longitudinal sleeve 84 does not mesh with the thread 86, and a first rotating ring 90 which is provided with a lever 92 is loosely but non-rotatably mounted on the vertical support shaft 80 wherein the rotation of the shaft 80 is prevented by a key 94 which is disposed within the slit 88. A second rotating ring 96 provided with a wheel 98 is disposed over the first rotating ring 90 and is meshed with the upper threaded portion of the vertical support shaft 80. For the purpose of rotating the second rotating ring 96 at a stationary position, a lever means 100 which prevents either upward or downward movement of the vertical shaft 80 is engaged within a recess 102 formed in the outer periphery of the second rotating ring 96. The lower end of the lever 100 is fixedly secured to the top of the storage tank 36. To maintain the smooth elevational and rotational movements of the longitudinal sleeve 84, packings 101 are provided between the vertical shaft 80 and the longitudinal sleeve 84 to prevent the intrusion of dust. On the top of the vertical shaft 80, a stopper (shown in dotted line) or an equivalent element is mounted and prevents the key 94 from loosening.

Since the lid means 68 of this invention is constructed in the above way, the rotation of the wheel 98 causes the downward movement of the vertical support shaft 80, and consequent lowering of the supporting arm 74 which is normally biased into contact with the bottom surface of the ring seat 66 away from the ring seat 66. Subsequently when the rotating ring 90 is rotated about 90 degrees by the manipulation of the lever 92, the vertical shaft 80 is also rotated through the same angle whereby the lid means 68 which is supported by the supporting arm 74 is rotated horizontally, facilitating the opening of the charging inlet 39.

To close the charging inlet 39, the lid means 68 including its operating means just described are all operated in the opposite manner to open the charging inlet 39. In the above closing operation, the upward movement of the supporting arm 74 causes the compression of the central press means 82 after the lid 68 comes into contact with the ring seat 66, whereby the lid means 68 can be pressed onto the entire periphery of the ring seat 66 with a uniform sealing pressure.

Figure 10:
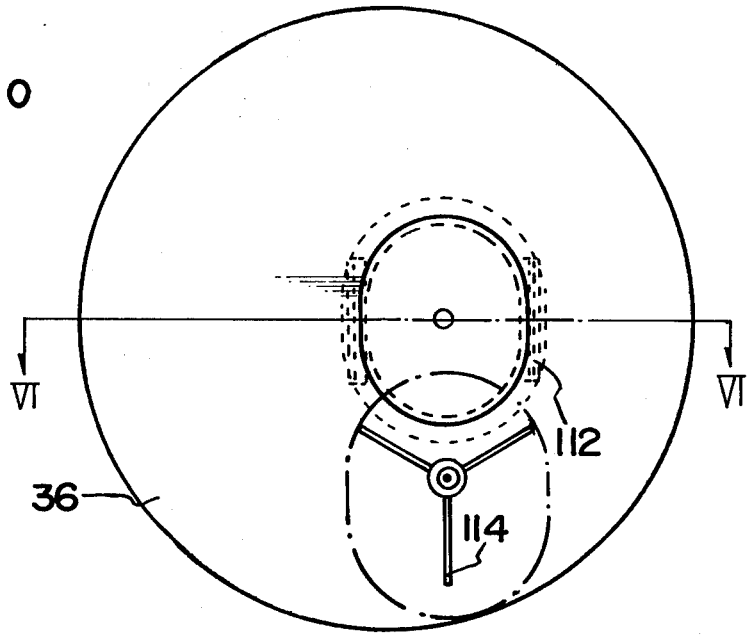
FIG. 10 is a plan view of the storage tank showing especially a modified form of the lid means.
Figure 11:
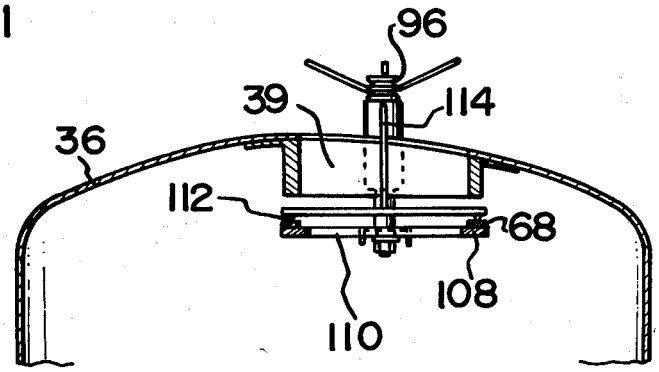
FIG. 11 is a longitudinal cross sectional view of the storage tank taken along the line VI—VI of FIG. 10.

The lid means 68 can be also constructed as shown in FIG. 10 and FIG. 11 such that the opening or closing of the charging inlet is conducted by the horizontal sliding movement of the lid means 68.

In the construction of FIGS. 10 and 11 a supporting plate 108 has an area at least the same as the lid means 68 and this plate 108 is formed with an opening 110 which has substantially the same diameter as that of the charging inlet 39. The vertical movement of the lid 68 is conducted only by the second rotating ring 96. Accordingly, instead of the first rotating ring 90, guides 112 are provided on the supporting plate 108 and slidably mount the lid means 68 thereon. Handle 114 extends upwardly from lid 68. Therefore, after lowering the supporting plate 108 by rotating ring 96, the lid means 68 is slid along the guides 112 so that the opening 110 formed in the supporting plate 108 comes into alignment with the charging inlet 39 and the charging inlet 39 opens.

As described above, the charging inlet 39 of the storage tank 36 is opened or closed by moving the lid 68 horizontally. Furthermore, in the above operation, the slight lowering of the lid means 68 is sufficient to facilitate the closing or opening of the charging inlet, whereby even when the storage tank 36 is almost entirely filled with refractory material with its level close to the top of the tank 36, the lid 68 is operable. Therefore, the total volume of the storage tank 36 can be utilized effectively as the material-storing portion of the tank 36 and accordingly, it becomes unnecessary to charge the refractory material into the storage tank 36 as frequently as in the past.

Below the outlet 40 of the tank 36, a flow regulating valve 116 is disposed which regulates the amount of refractory material to be applied by a throttle plate 118 thereof.

Figure 12:
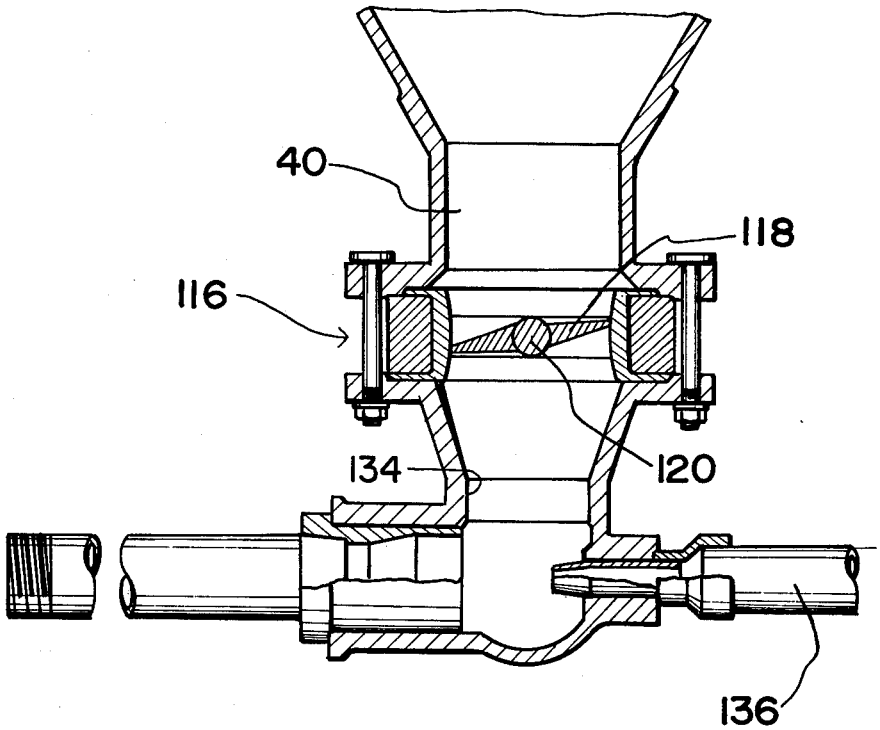
FIG. 12 is a cross-sectional front view of the flow regulating valve employed.
Figure 13:
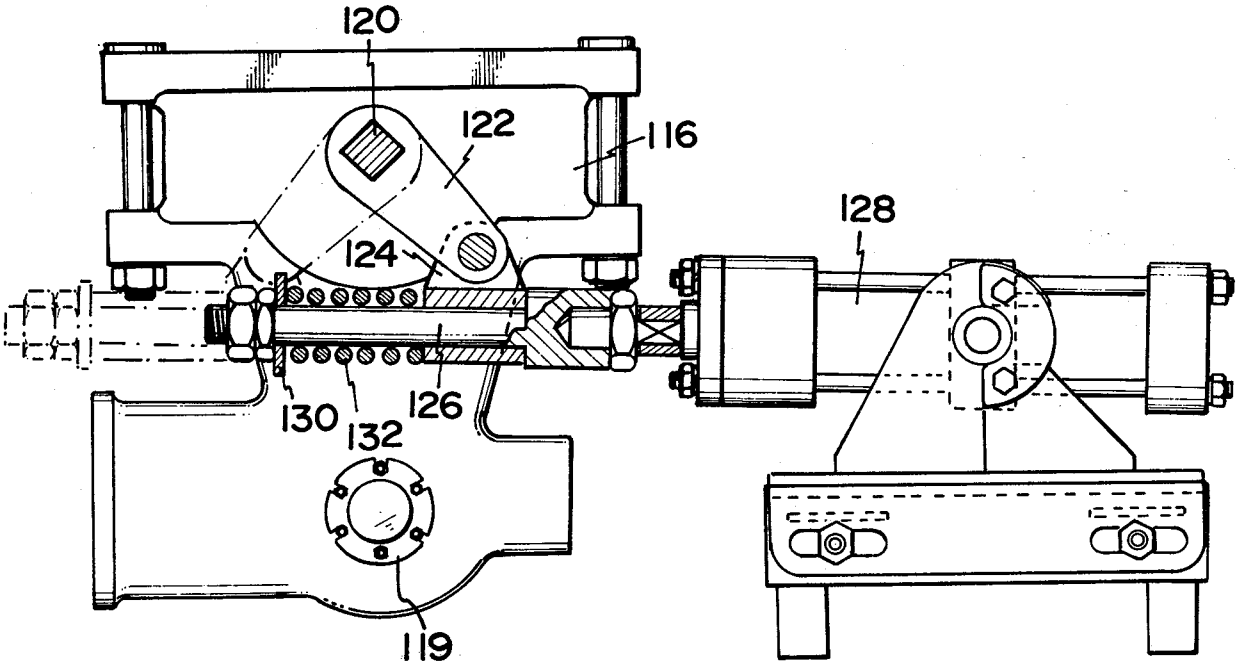
FIG. 13 is an enlarged side view of the flow regulating valve shown in FIG. 12.

The flow regulating valve 116 has the following construction. In FIG. 12 and FIG. 13, the throttle plate 118 is fixedly mounted on a transverse rotatable shaft 120 which, in turn, has one end thereof secured to the proximal end of an operable lever 122. The distal end of the lever 122 is pivotally connected with a pivoting sleeve 124 within which an actuating or reciprocating rod 126 of a hydraulic cylinder 128 is slidably disposed. A stop member 130 is secured to the front portion of the actuating rod 126 at a position spaced from the pivoting sleeve 124 and a compression spring 132 is disposed between the stop member 130 and the pivoting sleeve 124 such that it absorbs the excessive torque exerted by the actuation of the hydraulic cylinder 128.

Refering to other parts of the flow regulating valve 116, an observation window 119 which facilitates the easy observation of the flow of the refractory material passing through the valve 116 is provided on the spherical side wall of the valve 116. This window 119 is also removable so that the jet gun 136 which may be clogged by refractory material is easily declogged. Of course, the window 119 can be made of heat resistant steel plate if it is used for only removing the material clogged in the bottom portion of the valve which is adjacent to the gun 136.

The compression spring 132 can be replaced by any suitable means which has the same function such as a leaf spring, hydraulic or pneumatic shock absorber.

In general, when trouble occurs, such as clogging of the refractory material in the valve 116 or in the middle of the flexible hose 16, or an intrusion of foreign material into the valve 116, the flow regulating valve 116 of this invention is prevented from rotating thereof without causing the breakage of any parts of the valve 116. Namely, in such instances, even when the actuating rod 126 is retracted in a direction to close the valve 116, the operable lever 122 which is secured to the rotatable shaft 120 and the pivoting sleeve 124 do not move since the retraction of the actuating rod 126 is absorbed due to the compression of the spring 132 disposed between the lever 122 and stop member 130.

Accordingly, since excessive torque which is caused by the reciprocating movement of the actuating rod 126 is absorbed by the compression spring 132, the breakage of the rotating shaft 120 can be obviated.

The flow regulating valve 116 has an opening at the lower end thereof which, in turn, communicates with the flexible hose 16 through which the refractory material is charged to the inner spray pipe 10.

In order to give flow energy to the refractory material which passes through the flexible hose 16 and the inner spray pipe 10, an air jet gun 136 is provided at the lower end of the flow regulating valve 116 disposed opposite to the opening 134.

This air jet gun may be provided at any suitable position of either the flexible hose, the spray pipe or the spray nozzle.

The water storage tank 38 has a water outlet 138 at the bottom thereof which is connected to one end of a cooling water supply tube 140. The cooling water supply tube 140 has its other end connected in an inlet opening 142 formed in the outer spray pipe 12 at a location so that the water charged into spray pipe 8 cools the entire spray pipe 8 which is subjected to high radiation heat temperatures during the spray operation.

The outer spray pipe 12 has another water outlet opening 144 which is connected to one end of a warm water return tube 146 wherein the water warmed during the circulation thereof within the spray pipe 8 is discharged into the return tube 146 by way of the outlet opening 144.

The return tube 146 has its other end connected to the flexible hose 16 at the middle thereof by way of a three-port valve 148 wherein the warmed water which passes through the return tube 146 is mixed with the powder-like refractory material to produce refractory material in a wet slurry form which is charged into the inner spray pipe 10 by way of the flexible hose 16.

At the rear of the transport car 2, an air compressor 150 is provided which supplies compressed air to the air jet gun 136, the water storage tank 38, the refractory-material storage tank 36 and other parts of the apparatus which require compressed air. A diesel engine 151 for moving the transport car 2 is also mounted at the rear portion on the transport car 2 along with its radiator 153.

This air compressor 150 and the diesel engine 151 are both protected from dust and the like by a cover means 152.

Figure 14:
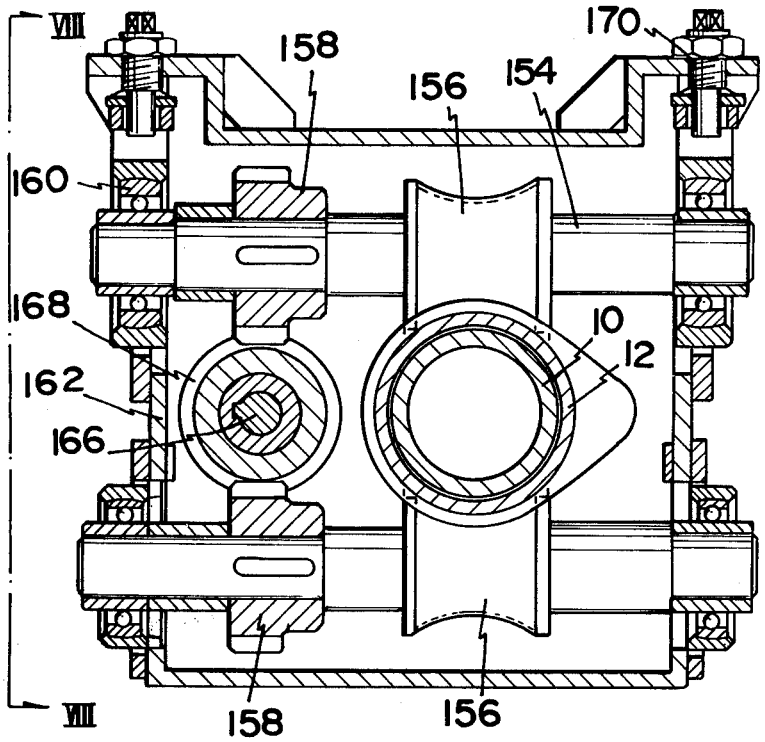
FIG. 14 is an enlarged transverse cross-sectional view of slide means of this apparatus for sliding the outer spray pipe taken along the line VII—VII of FIG. 3.
Figure 15:
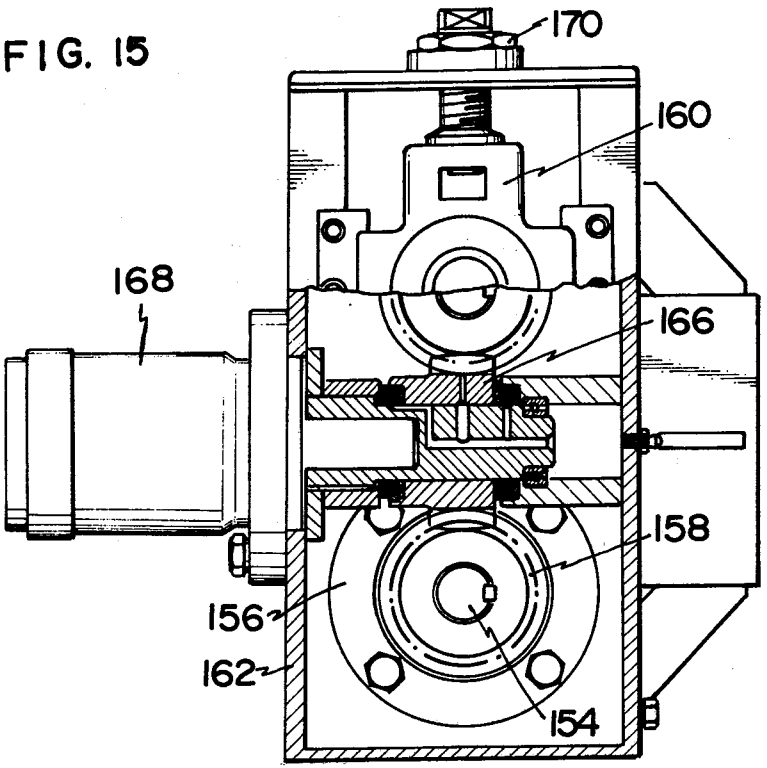
FIG. 15 is a side view of the slide means taken along the line VIII—VIII of FIG. 14.

In FIG. 14 and FIG. 15, the mechanism to slidably move the outer pipe 12 relative to the tiltable cylindrical body 18 is shown wherein each roller shaft 154 which fixedly carries a pipe-propelling roller 156 and a spiral gear 158 in series has both ends thereof journalled by ball bearings 160 which, in turn, rest within openings formed in the side walls of a casing 162. A spiral gear 164 which is fixedly mounted on a drive shaft 166 of a power-operated motor 168 is meshed with spiral gears 158 so that the actuation of the motor 168 causes the rotation of the pipe-propelling rollers 156 which, in turn, move the outer spray pipe 12 forward or backward within and relative to the cylindrical body 18.

The pressure to pinch outer spray pipe 12 by the two opposing rollers 156 is adjusted by a bolt and nut means 170 disposed adjacent each ball-bearing 160.

Figure 16:
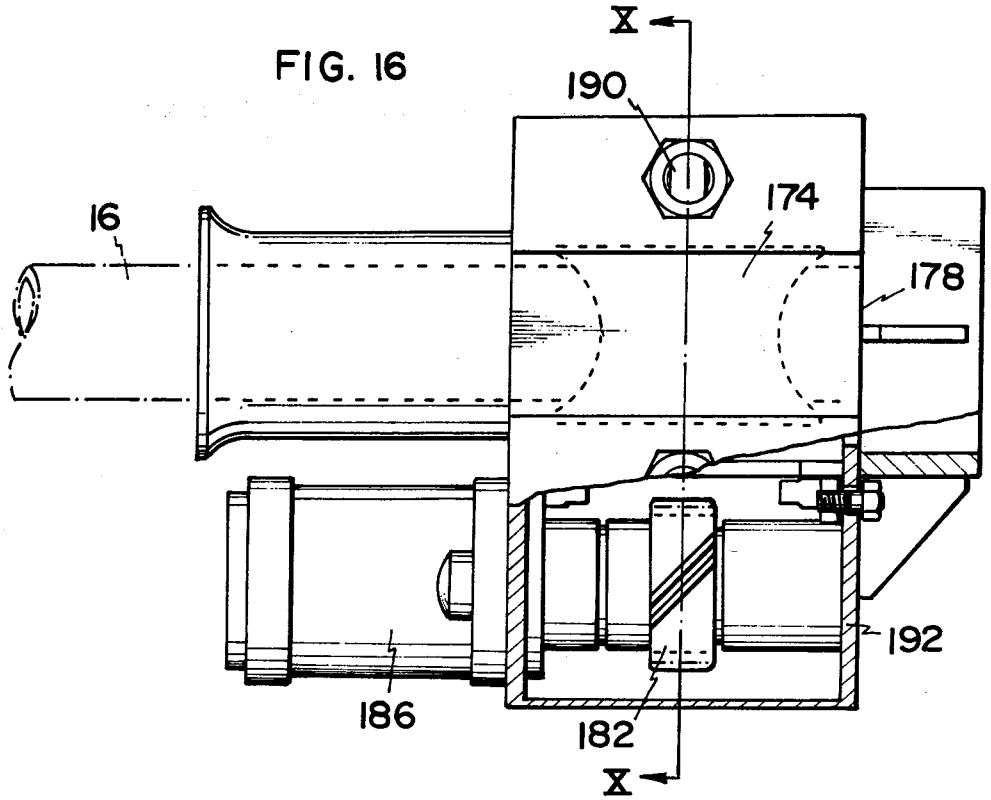
FIG. 16 is an enlarged plan view of slide means for sliding the inner spray pipe relative to the outer spray pipe taken along the line IX—IX of FIG. 3.
Figure 17:
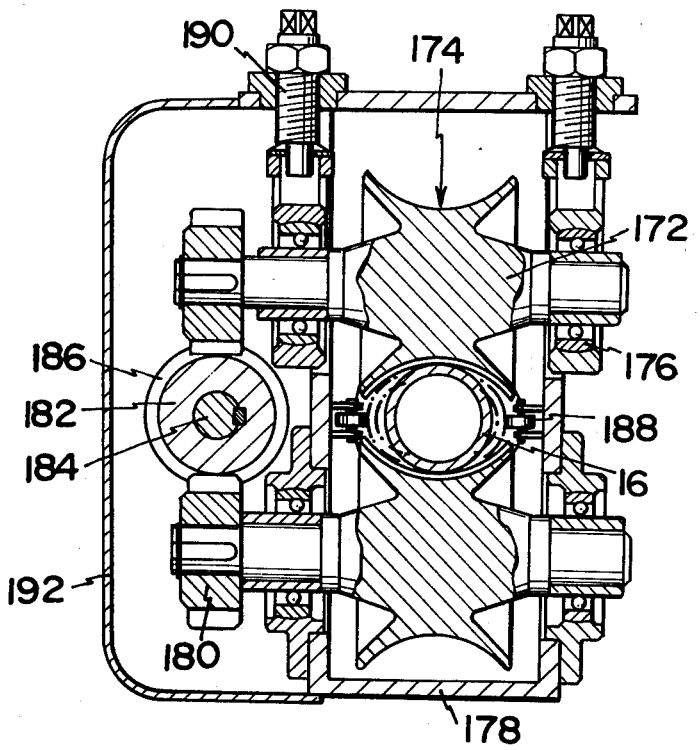
FIG. 17 is a longitudinal cross-sectional view of the slide means taken along the line X—X of FIG. 16.

In FIG. 16 and FIG. 17, the mechanism to slidably move the inner spray pipe 10 relative to the outer spray pipe 12 is shown wherein each of a pair of parallely-disposed roller shaft 172 are integrally provided with a second pipe-propelling roller 174 and have both ends journalled by ball bearings 176 which rest in openings formed in the side walls of a casing 178. Each roller shaft 172 is further provided with a spiral gear 180 at the extension adjacent to one journalled portion thereof. A spiral gear 182 which is fixedly mounted on a rotating shaft 184 of a power-operated motor 186 is meshed with spiral gears 180 so that the actuation of the motor 186 causes the rotation of the second pipe-propelling rollers 174 which, in turn, slidably move the inner spray pipe 10 forward or backward within and relative to the outer spray pipe 12.

To be more specific and exact, the second pipe-propelling rollers 174 pinch the flexible hose 16 (not the inner spray pipe 10) as can be observed from FIG. 17. When the above rollers 174 are rotated by the activation of motor 186, the flexible hose 16 which is now depressed in an elliptical hollow cross section is moved longitudinally in either forward or backward direction due to the friction at the inter-surface of rollers 174 and flexible hose 16.

As described previously, since the hose 16 is connected with the inner spray pipe 10, the inner spray pipe 10 moves backwards or forwards longitudinally along with the flexible hose 16.

The casing 178 is also provided with two opposing side rollers 188 which rotatably come into contact with the expanded or distended round side of the hose 16 so as to guide the hose 16.

The pressure to pinch the flexible hose 16 by the two opposing rollers 174 is adjusted by a bolt and nut means 190 disposed above each ball bearing 176. Spiral gears 180 and 182 are protected from dust or the like by a cover means 192 which is fixedly attached to the outer spray pipe 12 together with the casing 178.

Figure 18:
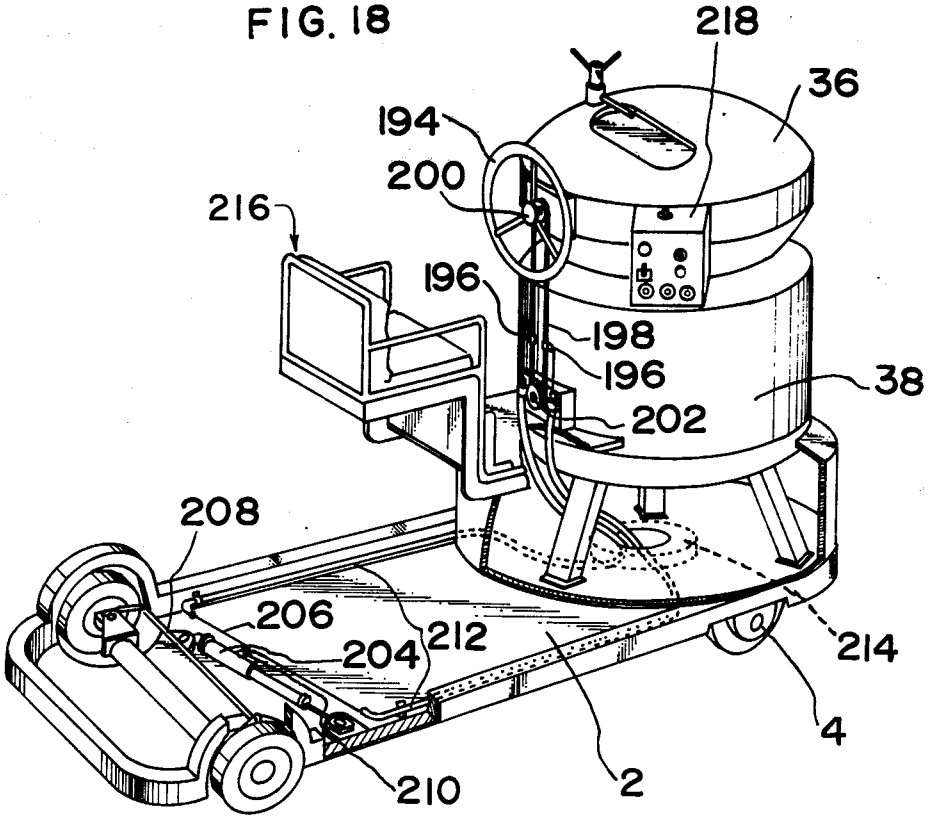
FIG. 18 is a schematic view of the skeleton structure of the lining apparatus showing the mechanism for steering the transport car.

Referring to the means for controlling the apparatus of this invention shown in FIG. 18, a steering wheel 194 which steers the transport car 2 hydraulically by manipulating the rear wheels 4 is disposed adjacent to the upper portion of the refractory-material storage tank 36.

The mechanism to steer the transport car 2 has the following construction.

In FIG. 18, two lugs 196 which vertically move in opposite directions by the rotation of the steering handle 194 are attached to an endless chain 198 which is extended between a steering handle shaft 200 and a follower shaft 202. These lugs 196 are connected with a hydraulic power steering unit 204 by means of throttling wires 206. This power steering unit 204 which can steer the rear wheels 4 has one end connected with a rear-wheel steering link 208 and the other end pivotally secured to the frame of the transport car 2. Referring other parts of this mechanims, numeral 210 indicates a throttling lug to which throttling wires 206 are connected, numeral 212 indicates casing tubes which slidably enclose throttling wires 206 and numeral 214 indicates a hollow rotary shaft for running the electric connections and hydraulic circuits as well as throttling wires.

Figure 19:
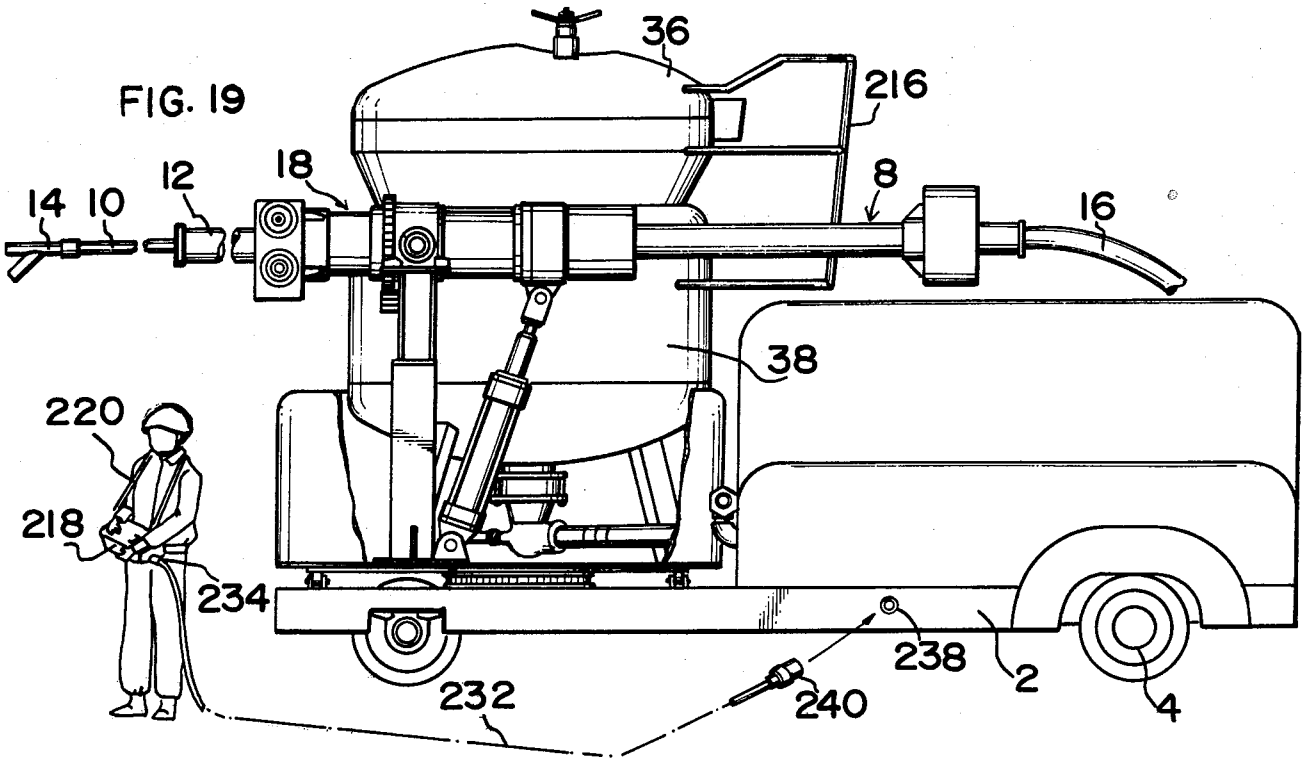
FIG. 19 is a side view of the apparatus regulated by a remote control means.
Figure 20:
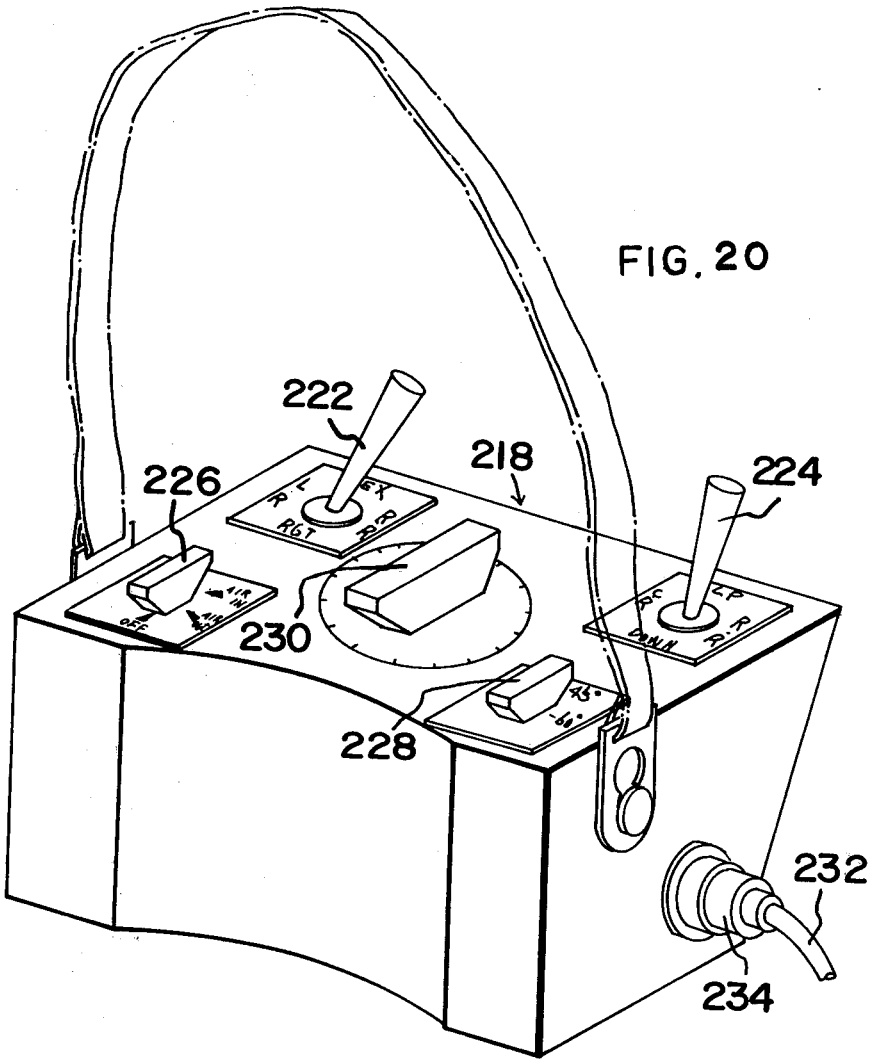
FIG. 20 is a schematic view of the remote control means of FIG. 19.

Of course, the control panel 218 for controlling the apparatus of this invention which is mounted on the side of the storage tank 36 adjacent to the steering seat 216 can be a portable type as shown in FIG. 19 so as to facilitate the remote control of the apparatus wherein the operator can hang the portable control panel or device 218 from his shoulder by a suspending belt 220. The portable control device 218 is provided with the desired number of switching means as shown in FIG. 20 wherein a first lever 222 controls the longitudinal movement and horizontal rotation (by turntable 26) of the spray pipe 8, a second lever 224 controls the tilting movement and rotation on the axis (by pipe rotating means) of the spray pipe 8, a third lever 226 controls the supply of water and/or air, a fourth lever 228 selects the horizontal rotation angle of the spray pipe either 45 degrees or 60 degrees, and a fifth lever 230 regulates the amount of water to be mixed with refractory material in a powder-like form.

The remote control means is further provided with the following parts wherein numeral 232 indicates remote control wiring which has one end electrically connected with the terminal 234 of the control panel 218 by way of a suitable connector and another end connected with the terminal 238 of the electric circuit arranged within the lining apparatus by way of another connector 240.

Figure 21:
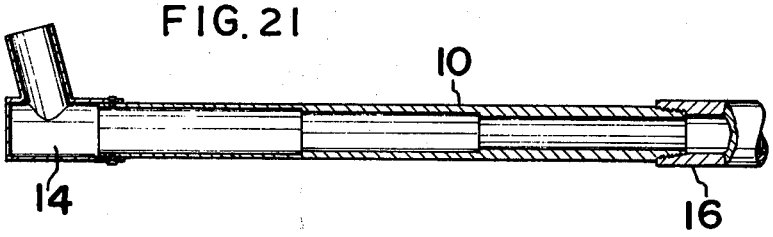
FIG. 21 shows a modification of the spray pipe used in the apparatus of this first embodiment.
Figure 22:
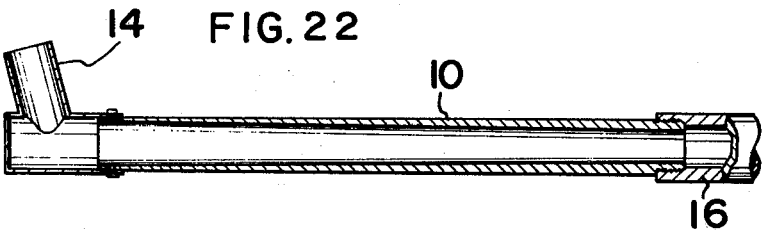
FIG. 22 shows another modification of the spray pipe used in the above apparatus.

Several modifications of the spray pipe 8 can be used in this invention. One modification is shown in FIG. 21 and FIG. 22 wherein the thickness of the spray pipe 10 is reduced toward the extremity thereof where the spray nozzle 14 is provided.

Due to the above construction, the bending movement exerted along the entire length of spray pipe 10 due to its own weight and the weight of the refractory material which passes through the pipe 10 is relatively low at the distal extremity of the spray pipe and 10 is relatively high at the proximal end of the spray pipe 10.

Therefore, the entire weight of the spray pipe 10 can be reduced without incurring a substantial load on the distal end thereof. This implies that the distal end of the spray pipe 10 is subject to only a small load and accordingly to a correspondingly small bending movement. Therefore the spray pipe deflects only a little, so that the spray pipe can be extended in a straight manner to the deepest portion of the furnace and can repair the furnace lining at that point with accuracy.

Figure 23:
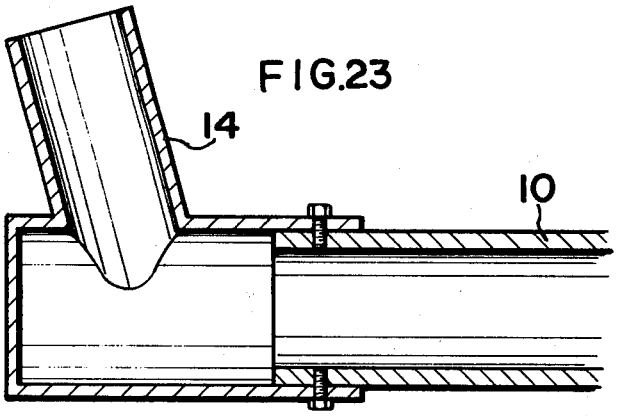
FIG. 23 is an enlarged cross-sectional view of the spray nozzle used in the above apparatus.

Another modification of spray pipe is shown in FIG. 23.

In this modification the forward extremity of the spray pipe 10 is snugly disposed within the rear opening of the spray nozzle 14. Due to such construction, the contacting surfaces of the spray nozzle 14 and spray pipe 10 are no longer subject to the frictional wear incurred by the flow of refractory material. Furthermore since the inner diameter of the spray nozzle 14 is larger than that of spray pipe 10, the refractory material and the water which may be unsatisfactorily mixed along the spray pipe 10 can be perfectly mixed within the spray nozzle 14 producing a satisfactory refractory material mix.

The manner in which the apparatus of this invention is operated is as follows.

The power-like refractory material is discharged from the hopper-like storage tank 36 by compressed air supplied from the air compressor 150 and the flow amount is regulated by the flow regulating valve 116. The discharged refractory material is conveyed through the flexible hose 16 with flow energy applied by the air jet from the air jet gun 136, The powder-like material subsequently passes through spray pipe 8 and eventually is sprayed from the spray nozzle 14.

If the refractory material is required in a wet slurry form, the water which is supplied to spray pipe 8 from the water storage tank 38 for cooling the spray pipe 8 is available. Namely, the cooling water is discharged from the water storage tank 38 by compressed air which is supplied from the air compressor 150. The cooling water then passes through the cooling water supply tube 140 into the spray pipe 8.

The water which is warmed after the above cooling operation is discharged from the outlet 144 and passes through the warmed water return tube 146 and reaches the three port valve 148. By opening the three port valve 148, the powderlike refractory material from the refractory-material storage tank 36 and the warm water from spray pipe 8 are mixed together forming refractory material in a wet slurry form at the junction where the return tube 146 and the flexible hose 16 meet. The thus produced slurry-like refractory material is supplied to spray pipe 8 and finally is sprayed from the spray nozzle 14 onto the inner surface of the furnace.

With respect to the longitudinal movement of spray pipe 8, since the spray pipe 8 consists of an inner and outer spray pipe 10, 12, the shooting pipe 8 can be extended even to the deepest part of the furnace so that a complete repair operation is assured.

Since the refractory material storage tank 36 and the water storage tank 38 are concentrically mounted adjacent to the support structure 24 on the turntable 26, they do not obstruct the rotating movement of the spray pipe 8. Furthermore, by restricting the height of the air compressor 100, the spray pipe can also be freely pivoted on the support 24 by means of the turntable 26. It should be noted that the spray pipe 8 is not necessarily a slidable one but can be fixedly mounted on the support structure 24.

In this invention, since all the necessary devices for applying a lining of refractory material, heat insulating material, or other insulating material and cement, namely, the spray-pipe control device, the storage tank, power-supply device, are all neatly mounted on the transport car, the apparatus can conduct the lining operation with high mobility and without the need of any other devices.

Furthermore, it can easily and freely conduct the spraying operation due to the spray pipe-control device.

Accordingly, the apparatus of this invention has the following advantages:

(1) Since all the necessary devices for the lining operation are mounted on the transport car, the self-supply lining operation can be conducted with high mobility.

(2) Since the spray pipe can be moved in any direction by means of the spray-pipe control device, the operability of the apparatus is enhanced.

(3) Since the powderlike refractory material is mixed with warmed water from the spray pipe at the junction of the flexible hose and the warmed water return pipe, the refractory material in a wet slurry form with the desired fluidity can be produced and sprayed onto the inner surface of a furnace.

(4) Since the charging inlet 39 of the storage tank 36 is opened or closed by moving the lid 68 horizontally and the slight lowering of the lid means 68 is sufficient to facilitate horizontal movement of the lid 68, even when the storage tank 36 is almost filled with the refractory material with its level close to the top of the tank 36, the lid is movable so as to open or close the charging inlet 39.

(5) Since the storage tank is provided with an agitator and a mechanism to detect the flow pressure within the storage tank which is exerted by the rotation of the agitator, the storage tank has two advantages, namely, (i) formation of the refractory-material bridges can be prevented and (ii) the amount of refractory material within the storage tank can be measured by monitoring the flow pressure within the storage tank.

(6) Since the spray pipe, the devices for controlling the position or movement of the spray pipe and the storage tanks are all mounted on the turntable, the manipulation can be facilitated without being obstructed. If desired, the water storage tank can be mounted on any portion of the transport car such that the construction is of a low height and will note interfere with the movement of the shooting pipe.

(7) Since the operator's cabin or seat is attached to the storage tank mounted on the turntable and the control panel is disposed adjacent to the operator's seat, the operator can readily control the manipulation of the spray pipe as well as the movement of the transport car while sitting on the seat.

(8) Since the spray pipe used in the apparatus of this embodiment can be constructed such that the pipe has a reduced thickness towards the extremity thereof, the distal end of the spray pipe is subject to a relatively small bending moment and therefore the spray pipe deflects a minimal amount. Accordingly, the spray pipe can be accurately extended in a straight manner to the desired portion of the furnace including the deepest portion thereof.

SECOND EMBODIMENT

This embodiment relates to apparatus for repairing the lining of a furnace and is characterized by having a hose-supporting mechanism which prevents the flexible hose of the aforedescribed first embodiment from developing excessive slack so as to impart further mobility of the lining apparatus.

The apparatus of this embodiment is disclosed hereinafter in detail in conjunction with the attached drawings FIG. 24 through FIG. 31.

Figure 24:
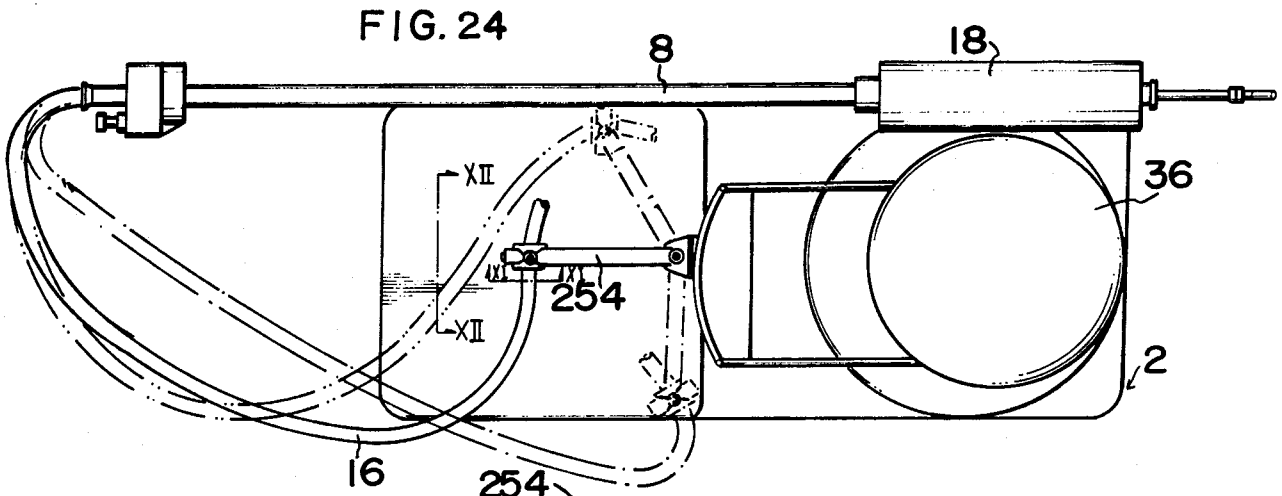
FIG. 24 is a top plan view of a lining apparatus of the second embodiment of this invention showing the flexible hose supporting mechanism.
Figure 25:
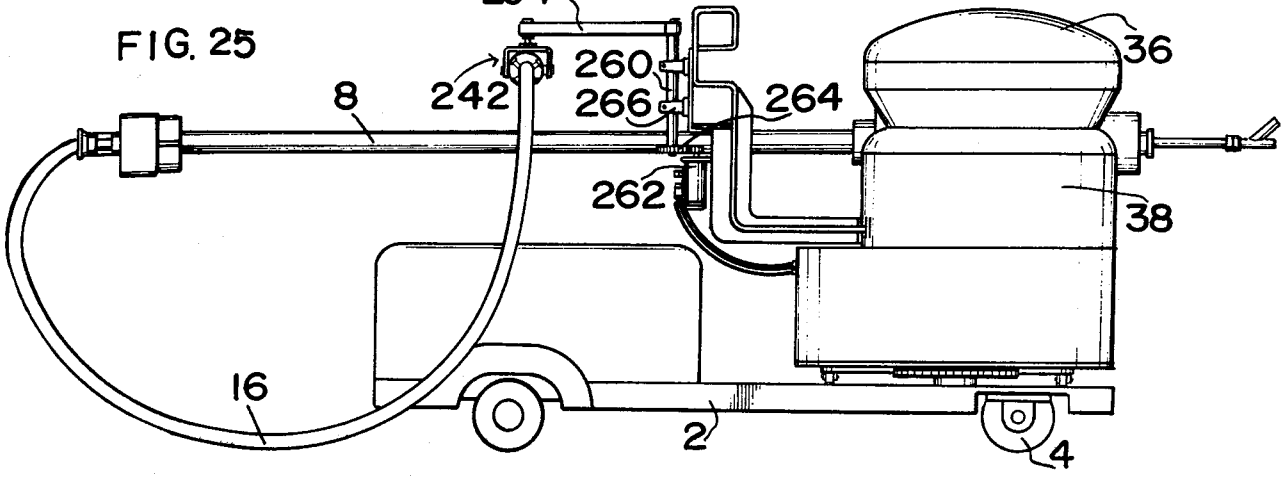
FIG. 25 is a side view of the lining apparatus.

In this embodiment, three methods can be used to prevent the excessive slackening of the flexible hose 16 as follows:

(i) by swinging or rotating the flexible hose 16 horizontally in a transverse direction relative to the apparatus as shown in FIG. 24 and FIG. 25

Figure 26:
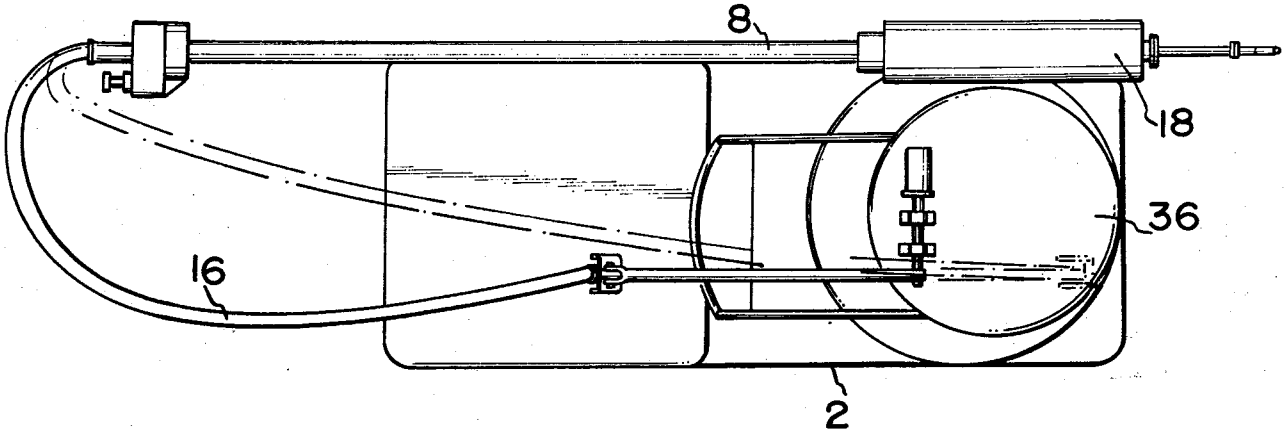
FIG. 26 is a top plan view of the lining apparatus of the second embodiment which is provided with a modified flexible hose supporting mechanism.
Figure 28:
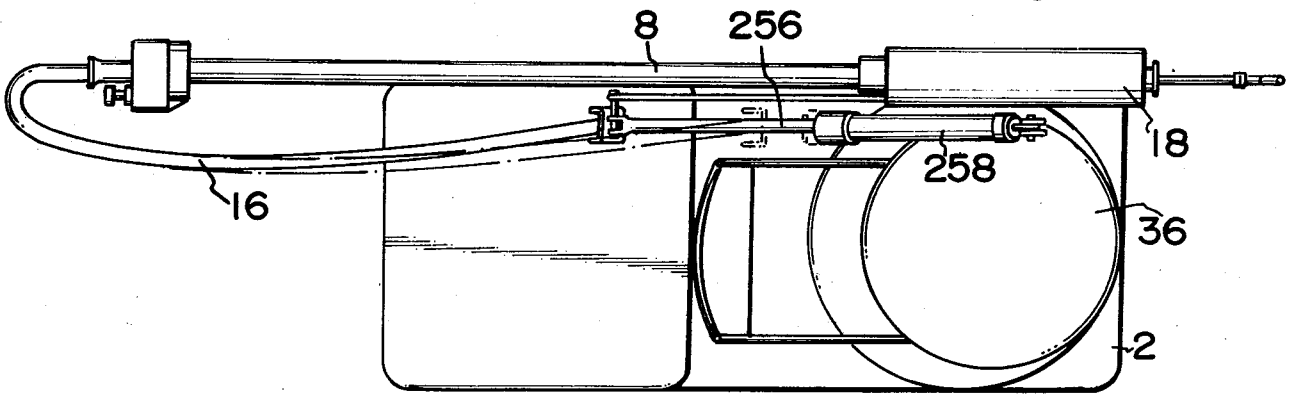
FIG. 28 is a plan view of the lining apparatus of the second embodiment which is provided with another modified flexible hose supporting mechanism.
Figure 27:
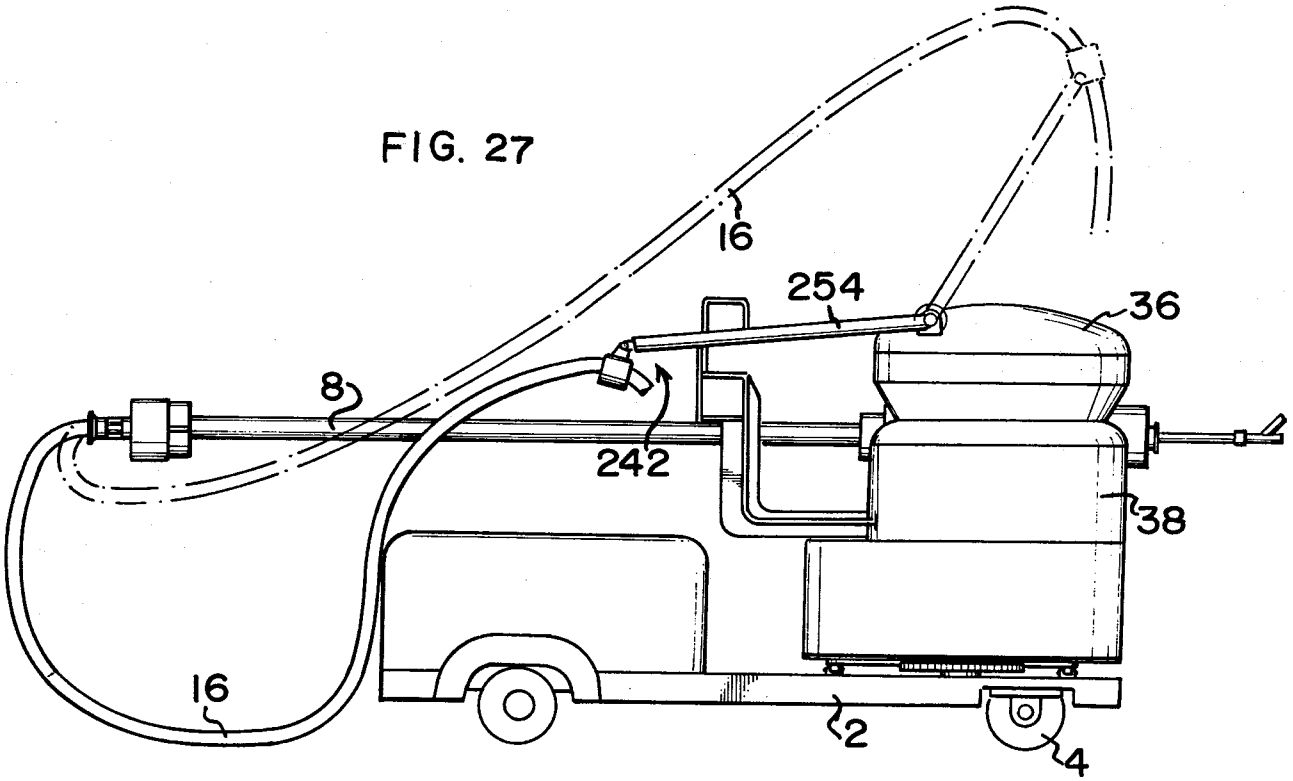
FIG. 27 is a side view of the lining apparatus shown in FIG. 27.
Figure 29:
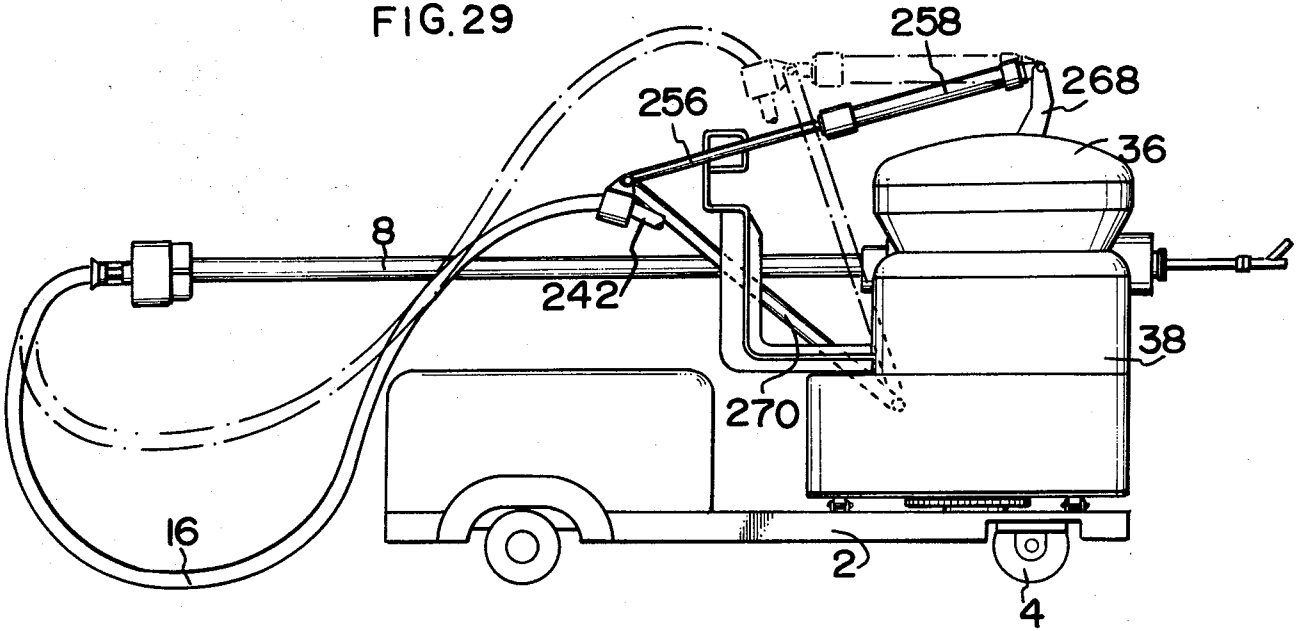
FIG. 29 is a side view of the lining apparatus.

(ii) by swinging or rotating the flexible hose 16 vertically as shown in FIG. 26 and FIG. 27 or (iii) by extending or retracting the flexible hose 16 in a lengthwise direction relative to the apparatus as shown in FIG. 28 and FIG. 29.

Figure 30:
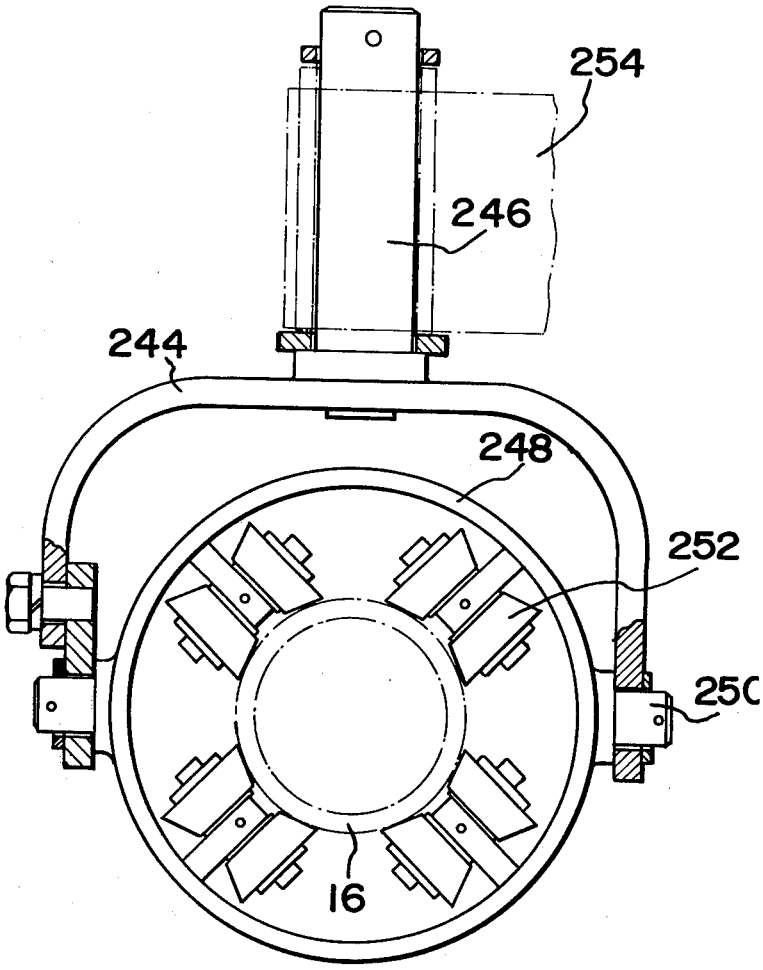
FIG. 30 is an enlarged front view of the pipe supporting mechanism taken along the line XI—XI of FIG. 24.
Figure 31:
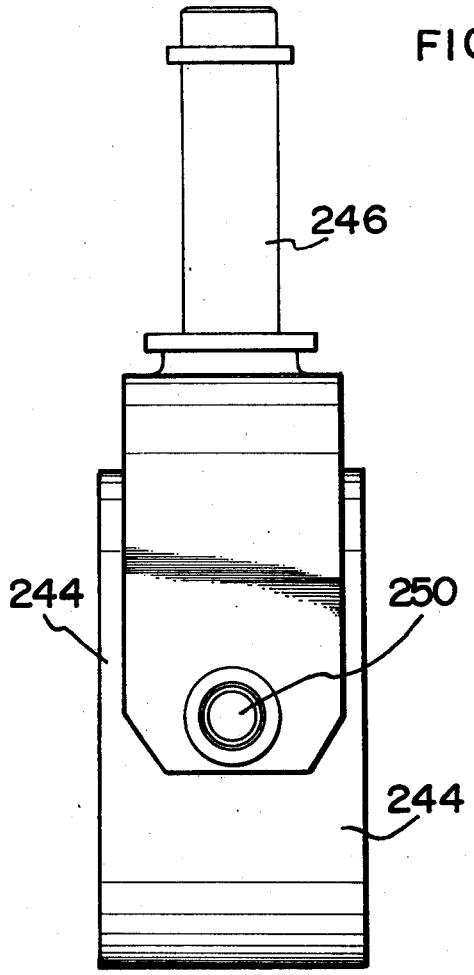
FIG. 31 is an enlarged side view of the pipe supporting mechanism taken along the line XII—XII of FIG. 24.

The construction of a suitable hose supporting mechanism 242 is clearly shown in FIG. 30 and FIG. 31.

In the drawings, a bifurcated hanger means 244 provided with a rotatable support shaft 246 thereon pivotally supports a cylindrical body 248 within its parallel arms by journalling trunnion portions 250 of the cylindrical body 248 in such arms. A plurality of rollers 252 which facilitate the smooth movement of the flexible hose 16 within the cylindrical body 248 are mounted on the inner peripheral wall of the cylindrical body 248 spaced equidistantly in a circumferential direction. The rotary support shaft 246 is pivotally attached to the free end of either a swinging arm 254 (FIGS. 24, 25, 26 and 27) or of an actuating rod 256 of a hydraulic cylinder 258 (FIGS. 28 and 29). The other end of the swinging arm 254 is fixedly secured to a vertical rotatable shaft 260 which is rotated by a power-operated motor 262 by way of a gear mechanism 264 wherein the rotation of shaft 260 imparts swinging movement to the arm 254 and the hose supporting mechanism 242.

The actuating rod 256 is extended or retracted by the actuation of the hydraulic cylinder 258 so as to impart a reciprocating movement to the hose-supporting mechanism 242. (Refer to FIG. 28 and FIG. 29).

Referring to other parts which facilitates the above swinging or reciprocating movement of the flexible hose 16, numeral 266 indicates bearings which rotatably support the vertical rotary shaft 260 (FIG. 25), numeral 268 indicates a support frame which is mounted on the top of the storage tank 36 and has the top thereof pivotally connected with the distal end of the hydraulic cylinder 258, and numeral 270 indicates a guide lever which facilitates the smooth reciprocation of the actuating rod 256.

In the above construction, since the flexible hose 16 can pass through the cylindrical body 248 by way of a plurality of rollers 252 disposed around the inner peripheral wall of the cylindrical body 248 and the swinging arm 254 or actuating rod 256 which rotatably hangs the cylindrical body 248 is given a swinging movement or reciprocating movement respectively, the middle portion of the flexible hose 16 can be supported by the hose supporting mechanism 242 such that the flexible hose 16 can be displaced in any direction at will in the air.

Furthermore, in each operation for controlling the spray pipe 8, such as reciprocating, rotating or tilting, the hose 16 can retain the desired slack sufficient to follow the above movement by displacing the supporting mechanism 242 to a position adjacent to a junction where the spray pipe 10 and the flexible hose 16 meet. The above displacement of the hose-supporting mechanism 242 is especially effective in the reciprocating movement of the spray pipe 8 wherein the inner spray pipe 10 slides within and relative to the outer spray pipe 12 while the spray flexible hose 16 moves within and relative to the cylindrical body or sleeve 248.

When the lining apparatus (including the transport car 2) is to be moved after the completion of a repair operation, the flexible hose 16 can be prevented from developing excessive slack by displacing the supporting mechanism 242 away from the above hose connection whereby the slumping of the flexible hose 16 onto the floor, which hampers the movement of the transport car, can be avoided.

Accordingly, since any excessive slack can be absorbed by the hose-supporting mechanism 242 of simple construction, the transport car 2 can move to any desired location without trouble caused by the flexible hose 16 and can be constructed as small as possible for facilitating the entry and working of the lining apparatus in a narrow working space.

THIRD EMBODIMENT

This embodiment relates to an apparatus for repairing the furnace lining which is characterized by having three devices which respectively measure the horizontal rotating angle, the tilting angle and the reciprocation distance of the spray pipe, whereby the thickness of the furnace lining can be measured with great accuracy resulting in an effective repair operation of the furnace lining.

In general, before applying refractory material onto the abraded portion of a furnace lining, the thickness of the furnace lining is checked to determine the degree of wear or abrasion of the furnace lining. Conventionally, however, this checking is done by a skilled operator who determines the thickness of the furnace lining using his past experience of observing the inside of a furnace.

Therefore, refractory material applied in the above way results in an irregular surface and an inaccurate repair operation.

This embodiment of the invention provides an apparatus for repairing a furnace lining which resolves the aforementioned defects, such that the apparatus facilitates the easy and correct measuring of the lining thickness which is of vital importance to the furnace lining operation which follows.

Figure 40:
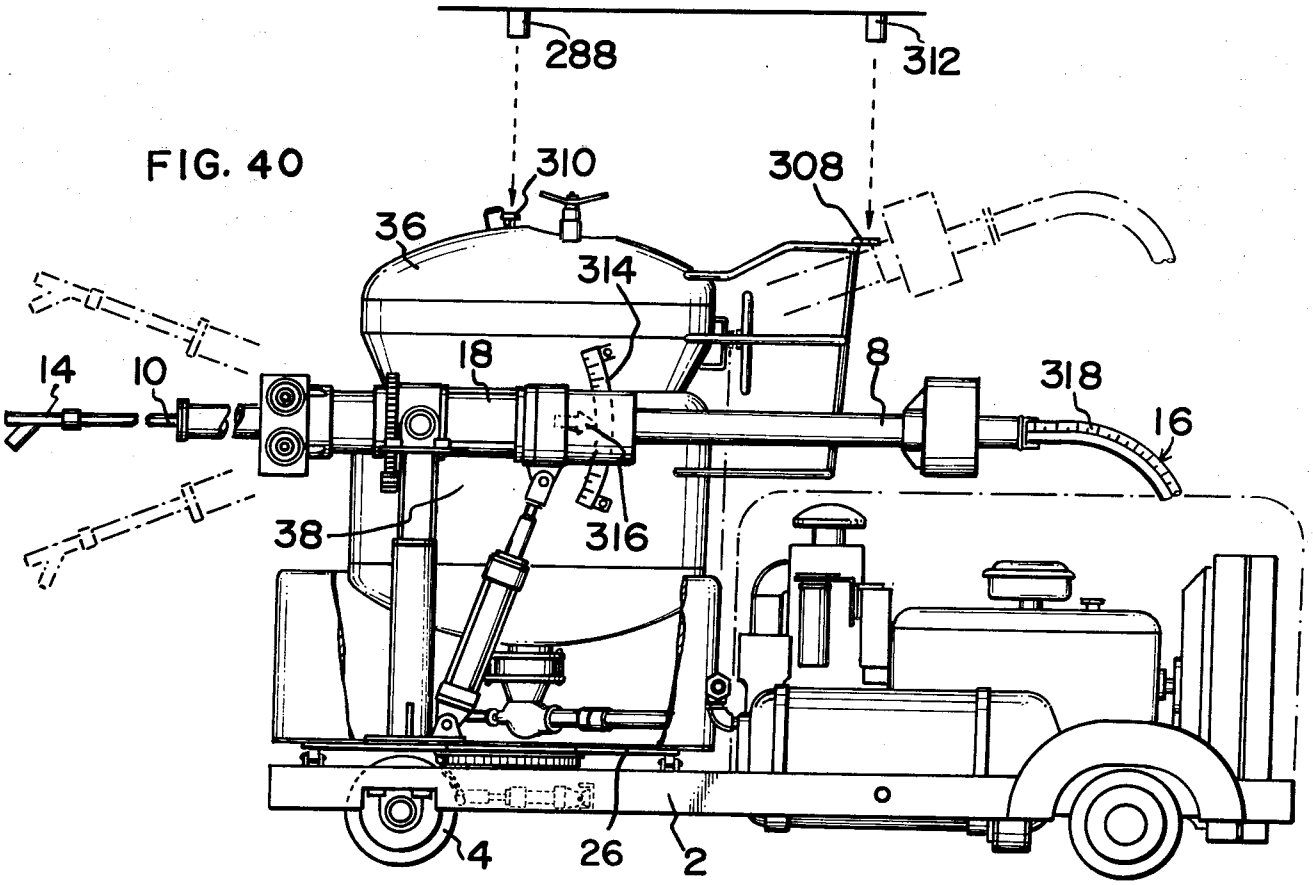
FIG. 40 is a side view of the lining apparatus of a third embodiment provided with the above measuring devices.
Figure 41:
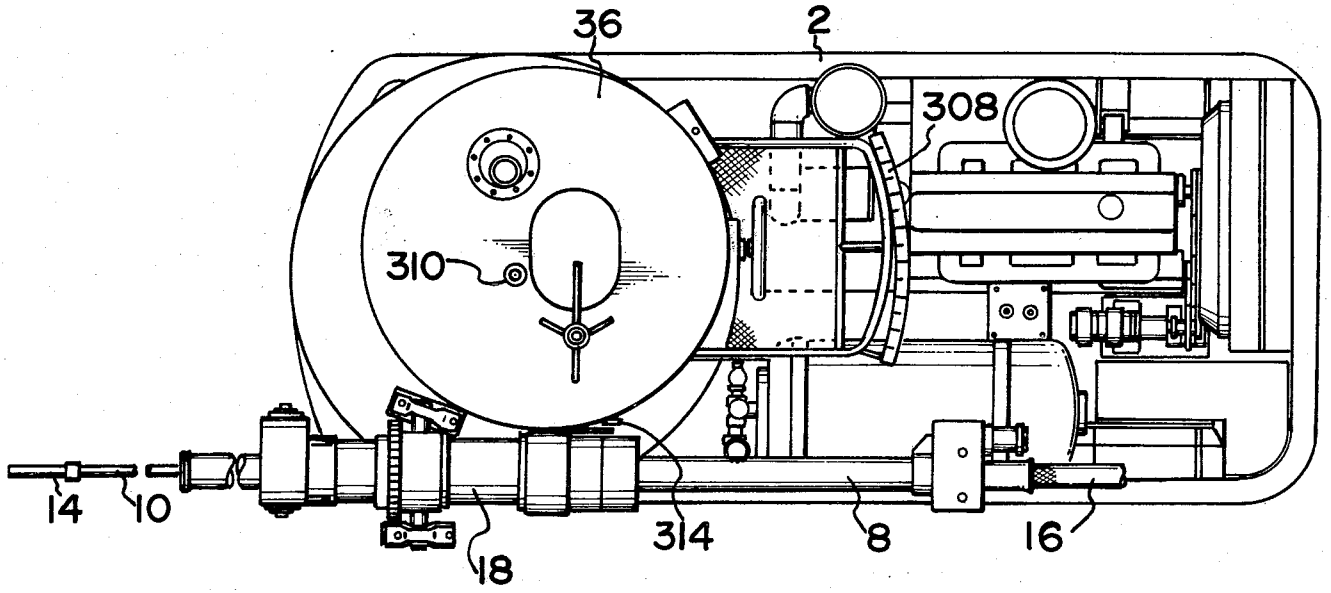
FIG. 41 is a plan view of the lining apparatus of FIG. 40.

The lining apparatus of this embodiment is shown in FIG. 40 and FIG. 41 wherein the lining device is provided with the three measuring devices.

However, before describing the lining apparatus of FIG. 40 and FIG. 41 in detail, the basic principles and structures of the measuring devices are first described in conjunction with the attached drawings, FIG. 32 through FIG. 39.

Figure 32:
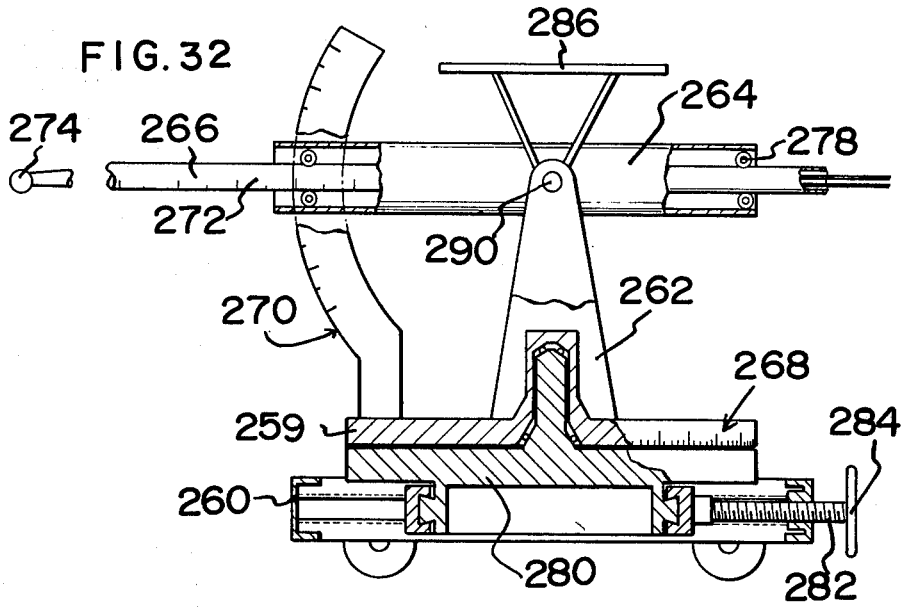
FIG. 32 is a side view of a measuring car mounted with measuring devices which is provided for the explanation of a lining device of third embodiment as shown in FIG. 40 and FIG. 41.

FIG. 32 shows a simplified and basic structure of the apparatus with which the basic measuring principle is described hereinafter.

In FIG. 32, a turntable 259 is rotatably mounted on a transport car 260. On the turntable 259, a vertical standard or column 262 which pivotally supports a cylindrical body 264 at the top thereof is fixedly mounted. An elongated bar 266 is slidably disposed within the cylindrical body 264 such that the bar 266 can be extended toward or away from the furnace within the tiltable cylindrical body.

Three measuring devices, namely, a first measuring device 268 which meaasures the horizontal rotating angle ($\alpha$) of the turntable 259, a second measuring device 270 which measures the vertical tilting angle ($\beta$) of the cylindrical body 264 and a third measuring device 272 which measures the reciprocation distance or length ($\chi$) of the elongated bar 266 are respectively mounted at suitable positions on the repair apparatus. Each measuring device is provided with a desired scale thereon.

Referring to other parts of the basic apparatus, numeral 274 indicates a contactor which is secured to the front extremity of the elongated bar 266 and comes into contact with the abraded surface of a furnace lining 276, numeral 278 indicates guide rollers which facilitate the smooth longitudinal movement of the elongated bar 266 relative to the cylindrical body 264, numeral 280 indicates a slide frame which is slidable longitudinally and transversely relative to the transport car 260, numeral 282 indicates screw arrangements which regulate the longitudinal and transverse sliding movement of the slide frame 280 relative to the transport car 260, numeral 284 indicates operating handles by means of which screw arrangements 282 are actuated, numeral 286 indicates a light-receiving table which receives the light emitted from a projector 288 mounted in the ceiling of a furnace room to detect the accurate position of the turntable 259 and numeral 290 indicates a pivot shaft which works as a fulcrum to permit tilting of the cylindrical body 264.

The manner in which the above measuring apparatus is operated now described.

Figure 34:
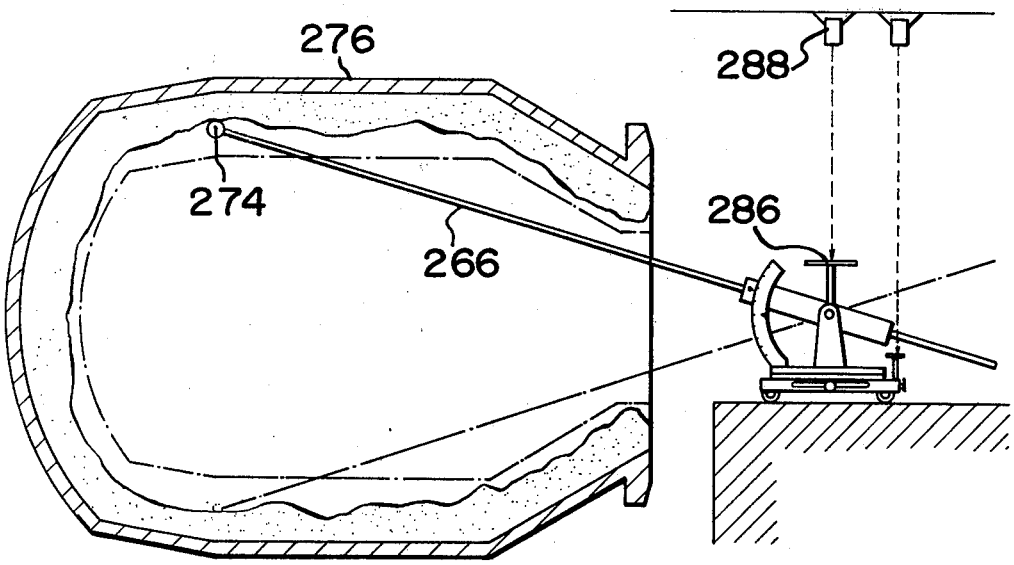
FIG. 34 is an explanatory view showing the measuring device measuring the wall thickness of a furnace.
Figure 35:
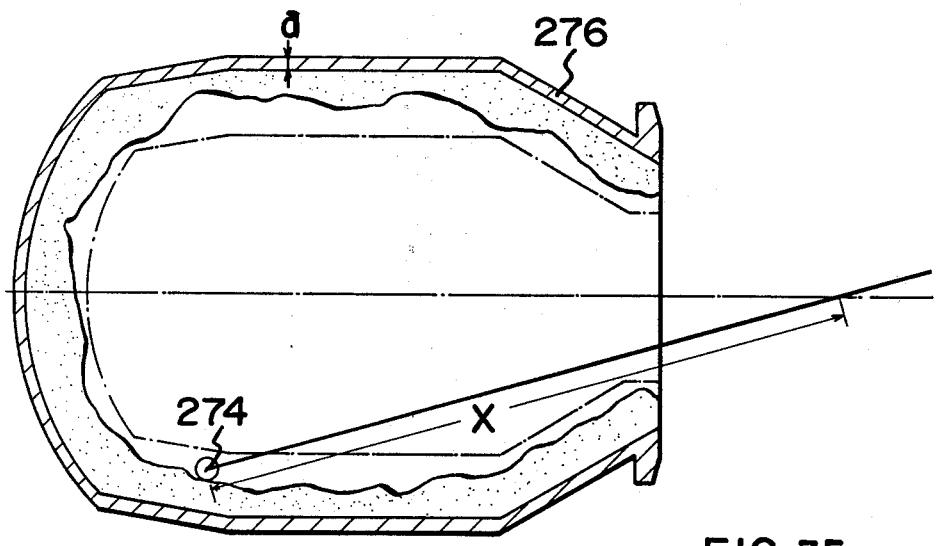
FIG. 35 is another explanatory view showing the length (X) of the elongated bar extended into the furnace.

The furnace 276 is tilted until it takes the horizontal position as shown in FIG. 34. Subsequently the transport car 260 is moved to a position adjacent to the opening of the furnace 276.

With the rotation of the turntable 259, the tilting of the cylindrical body 264 on the pivot shaft 290 and the reciprocation of the elongated bar 266, the contactor 274 which is secured to the front extremity of the elongated bar 266 is brought into contact with the desired portion of the furnace lining.

When the contacting of the contactor 274 with the furnace lining is affirmed, the rotating angle ($\alpha$) of the turntable 259, the tilting angle ($\beta$) of the cylindrical body 264 and the longitudinal sliding length (X) of the elongated bar 266 are measured by reading the scales of the respective devices. In this case, since the thickness of the outer peripheral wall of the furnace 276 is predetermined at the time the furnace 276 is located in the desired position, the thickness of the wall including the lining thickness can be calculated readily by either a calculator or a computer.

One example is described hereinafter for calculating the thickness of the furnace wall 276.

Referring to FIG. 36 of the drawings $$\overline{QP} = X$$

$$\overline{QQ'} = X_{sin\beta}$$

$$\overline{Q'P} = X_{cos\beta}$$

$$\overline{Q'Q''} = X_{sin\alpha cos\beta}$$

Namely, $$\overline{QQ''}^2 = QQ'^2 + Q'Q''^2$$
$$= X^2(\sin^2\beta + \sin^2\alpha\cos^2\beta)$$
$$= X^2(1 - \cos^2\alpha\cos^2\beta)$$

Accordingly, $$QQ'' = X\sqrt{(1 - \cos^2\alpha\cos^2\beta)}$$

Thickness of furnace wall $$Z = a - b - QQ''$$
$$a - b - X\sqrt{1-\cos^2\alpha\cos^2\beta}$$

where

X: the length between the pivot shaft 290 (point P) (slide and the center of the contactor 274 (point Q) length)

*b:* the radius of the spherical contactor 274

Z: the thickness of the furnace wall

Q'': the crossing point by the perpendicular from the pivot shaft 290 or the point Q (on the axis of the furnace) to the axis of the furnace and the axis of the furnace Q': the cross point by the perpendicular from the horizontal plane (tilting angle 0 degree) on which the center (Q) passes and the horizontal plane

*a:* the inner radius of the iron or steel furnace wall

In the above case, the inner radius ($a$) of the furnace and the radius ($b$) of the spherical contactor 274 are known at the designing stage while the rotating angle ($\alpha$), the tilting angle ($\beta$) and the sliding length (X) can be obtained by measuring devices 268, 270 and 272. By introducing the values obtained in the above way into the last formula, the thickness (Z) of the furnace wall can be readily calculated.

In the above formula, the elongated bar 266 is treated as a rigid body. However, in the actual calculation of the wall thickness, the deflection of the elongated bar 266 must be taken into account.

The modification of the basic measuring structure is described hereinafter in conjunction with FIG. 37 through FIG. 39.

Figure 33:
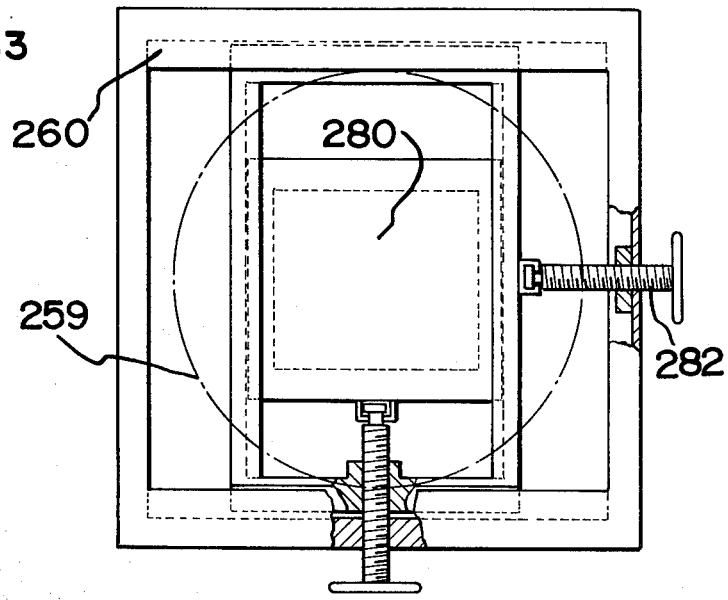
FIG. 33 is a plan view of the measuring device.

The lining apparatus has substantially the same construction as that of the basic structure described previously with the exception of the three measuring devices shown in FIGS. 32, 33 and 34.

Figure 39:
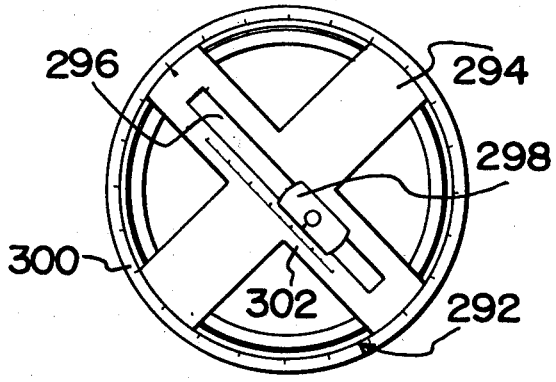
FIG. 39 is an explanatory view showing the movement of the cruciform plate and the collar within the ring-like structure of the modified measuring car.
Figure 38:
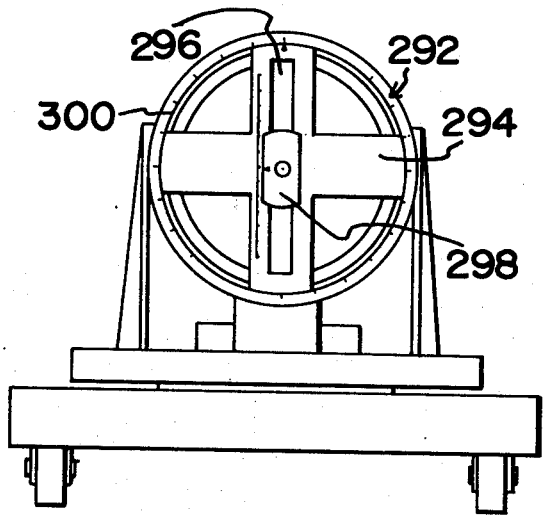
FIG. 38 is a front view of the modified measuring car of FIG. 37.

In FIGS. 37-39 of the drawings, a ring-like frame structure 292 is mounted on the transport car 260 in front of the cylindrical body 264. An arcuate cruciform rotary plate 294 is rotatably mounted on the ring-like frame structure 292 having its four outer edges rotatably engaged with the front periphery of the ring-like frame structure 292 in a dove-tail arrangement.

An elongated opening 296 is formed in either beam of the above cruciform plate 294 within which a collar 298 is slidably disposed such that the collar 298 slides along the opening in the beam. The elongated bar 266 which is slidable within the cylindrical body 264 is also slidable within the collar 298. The ring-like frame structure 292 is provided a with scale or readings on the front periphery thereof to enable a first measuring device 300 to determine the rotating angle$^{(\alpha)}$.

Other readings are provided on the cruciform plate 294 along the elongated opening 296 to enable a second measuring device 302 to determine the tilting angle ($\beta$) while still other readings are provided on and along the elongated bar 264 to enable a third measuring device 304 to determine the slide length (X).

Due to the above construction, depending upon the movement of the elongated bar, the collar 298 and cruciform rotary plate 294 are displaced on ring-like frame structure 292, and when the contactor 274 attached to the front extremity of bar 266 comes into contact with a portion of the inner furnace lining, collar 298 and rotary plate 294 take positions shown in FIG. 38. Subsequently, the rotating angle ($\alpha$) of the rotary plate 294 and the tilting angle ($\beta$) of the cylindrical body 264 are determined by reading the scale on the ring-like frame 292 and the scale 302 on the rotary plate 294 respectively.

By introducing values of ($\alpha$), ($\beta$) and (X) into the previously-mentioned formula, the wall thickness can be readily measured.

In FIG. 37 of the drawings, numeral 306 indicates a slide frame which corresponds to the slide frame 280 of the first basic measuring structure and on which the support column 262, the turntable 259 and the ring-like frame structure 292 are mounted.

The lining apparatus for repairing the furnace lining which is provided with the above-mentioned measuring devices is now disclosed hereinafter in conjunction with the attached drawings FIG. 40 and FIG. 41.

In the drawings, the measuring device for determining the horizontal rotating angle ($\alpha$) of the turntable 26 comprises an arcuate scale plate 308 having its radial center on the axis of the turntable 26, a center mark 310 which is provided on the storage tank 36 in alignment with the axis of the turntable 26 and a projector 312 which is mounted on the ceiling of a furnace room and which projects its light toward the arcuate plate 308.

In the above construction, the horizontal rotating angle ($\alpha$) can be determined by reading the scale of the arcuate scale plate 308 on which a spot-like light projected from the projector 312 falls.

The measuring device for determining the tilting angle ($\beta$) comprises an arcuate scale plate 314 vertically mounted on the side of the storage tank 36 and an arrow-shaped pointer 316 mounted on the corresponding side of the cylindrical body 18.

The measuring device for determining the slide length (X) of the spray pipe 8 consists of a scale 318 provided on and along the flexible hose.

The measuring devices mounted on the lining apparatus of this invention determine respective values as follows.

When the cylindrical body 18 is tilted by the actuation of the hydraulic cylinder 28, the tilting angle ($\beta$) of the cylindrical body 18 can be measured by reading the scale on the scale plate 314 indicated by the pointer 316.

The rotating angle ($\alpha$) of the turntable can be measured by the position of the spot light projected onto the arcuate scale plate 308.

The slide length (X) of the spray pipe 8 or the contactor 274 attached at the extremity of the pipe 8 is measured by the scale 318 provided on the flexible hose 16.

By introducing values ($\alpha$), ($\beta$) and (X) into the suitable calculator or computer the wall thickness of the furnace can be readily determined.

As has been described heretofore, the embodiment of this invention has the following advantages.

Corresponding to the rotation of the turntable 26, the tilting of the cylindrical body 18 and the sliding of the spray pipe 8 (or elongated bar 266), the wall thickness can be mechanically and readily determined with great accuracy.

FOURTH EMBODIMENT

This embodiment relates to modification of the apparatus for repairing the furnace lining by providing a heat-resistant window.

Figure 42:
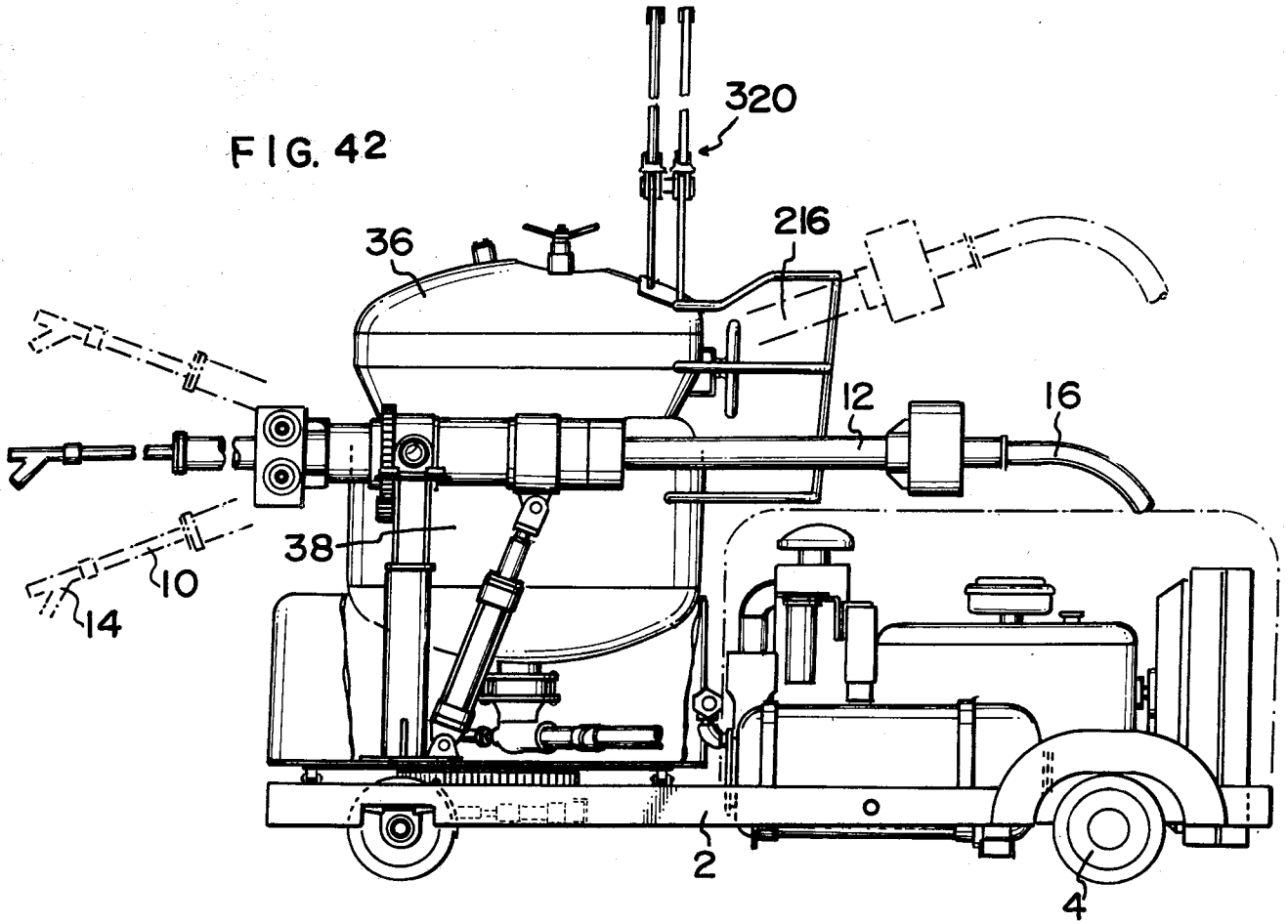
FIG. 42 is a side view of the lining apparatus of a fourth embodiment which is provided with a heat-resistant window in front of the operator's seat.
Figure 44:
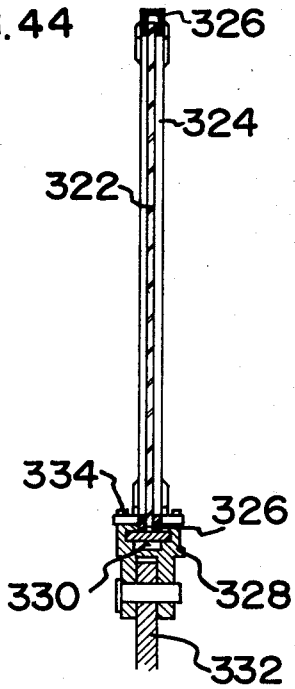
FIG. 44 is a cross-sectional view of the window taken along the line XIII—XIII of FIG. 43.
Figure 43:
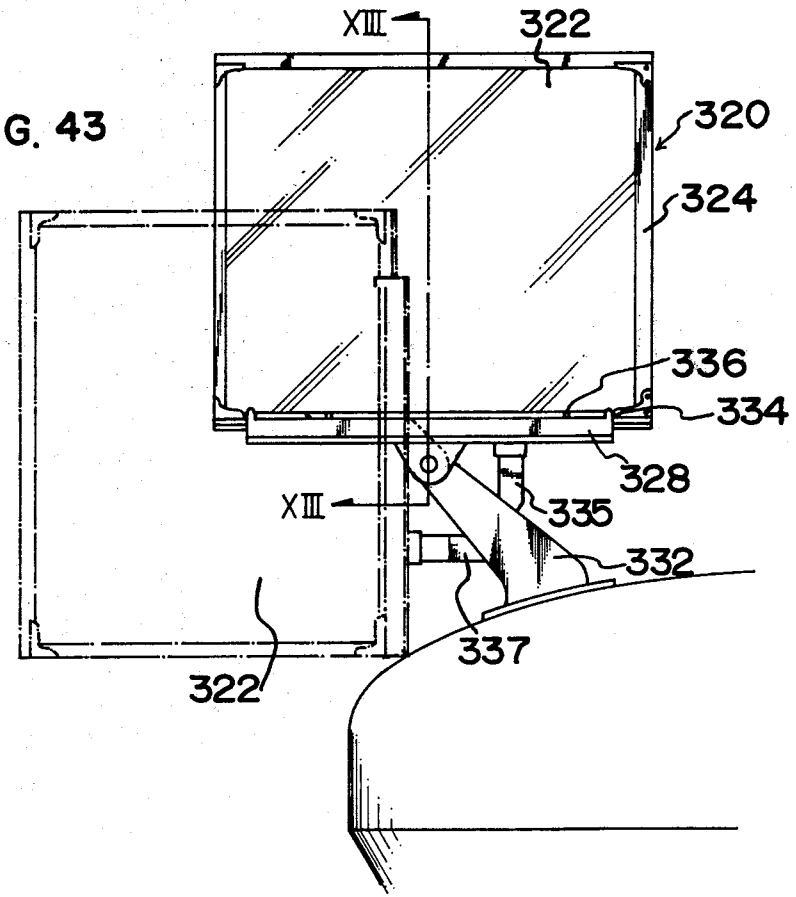
FIG. 43 is a fragmentary front view of the heat-resistant window of FIG. 42.

A heat-resistant window 320 can be provided in front of the steering seat 216 as shown in FIG. 42 through FIG. 44 so that the operator can observe and conduct the spraying operation without subjecting himself to high-radiation heat from the furnace.

In the drawing, a heat-resistant glass pane 322 is disposed within a window frame 324 by way of cushion means 326. A base frame 328 is provided with an elongated groove 330 which slidably receives the bottom of the window frame 324. This frame has the central portion pivotally mounted on the top of an inclined support frame 332 which, in turn, is mounted on the top of the storage tank 36.

The above pivotal connection provides for the rotation of the heat-resistant window 320.

At each upper longitudinal side of the base plate 328, two spaced-apart stop members 334 are provided which prevent the excessive sliding of the window frame 324 relative to the base frame 328 together with protrusions 336 formed onto window frame 324.

For the purpose of defining the angle of rotation for the window frame 324 at approximately 90 degrees, vertical and horizontal stop members 335, 337 are secured to the sides of the inclined support frame.

Due to the above construction, the heat-resistant window 320 of this invention has the following advantages:

(1) The window protects the operator from heated slag or refractory material which may splash from the furnace and from the radiation heat, thereby assuring the safety of the spraying operation.

(2) since a heat-resistant cushion material such as glass wool is positioned between the window frame and the heat-resistant window glass, the thermal stress which may occur due to the difference in expansion rates between the window frame and the window glass can be absorbed into the cushion material, thereby preventing the breaking of the window pane.

(3) Since the window frame is slidable relative to the base frame and is also pivotable 90° on the top of the inclined support frame, the observation area that the heat-resistant window of this invention covers can be widened.

(4) If the heat-resistant glass is formed of double pane construction, the window further enhances the safety of the spraying operation and of the heat-resisting effect.

Glass which absorbs ultraviolet rays or infrared rays can also be employed.

FIFTH EMBODIMENT

This embodiment relates to the lining apparatus of this invention which is further provided with a system for automatically declogging the spray nozzle.

The manner in which the refractory material is sprayed is briefly explained again to facilitate the understanding of this embodiment.

As has been explained heretofore, the refractory material in a powder-like form is charged into the storage tank 36. This charged refractory material is discharged from the bottom outlet 40 thereof and subsequently the flow amount of the refractory material is regulated by the flow regulating valve 116. Then the regulated amount of refractory material is supplied into spray pipe 8 by way of the flexible hose 16 with the aid of the air gun 136 which imparts flow energy to the refractory material. The water stored in the storage tank 38 is supplied into spray pipe 8, which is subject to high radiation heat, through the cooling water supply tube 140 and the warmed water produced after cooling spray pipe 8 is recycled into the middle portion of the flexible hose 16 so that the refractory material in a dry form is mixed with the warmed water. Finally, the refractory material which is now in a wet-slurry form is sprayed from the spray nozzle 14 onto an abraded portion of the furnace lining.

Figure 45:
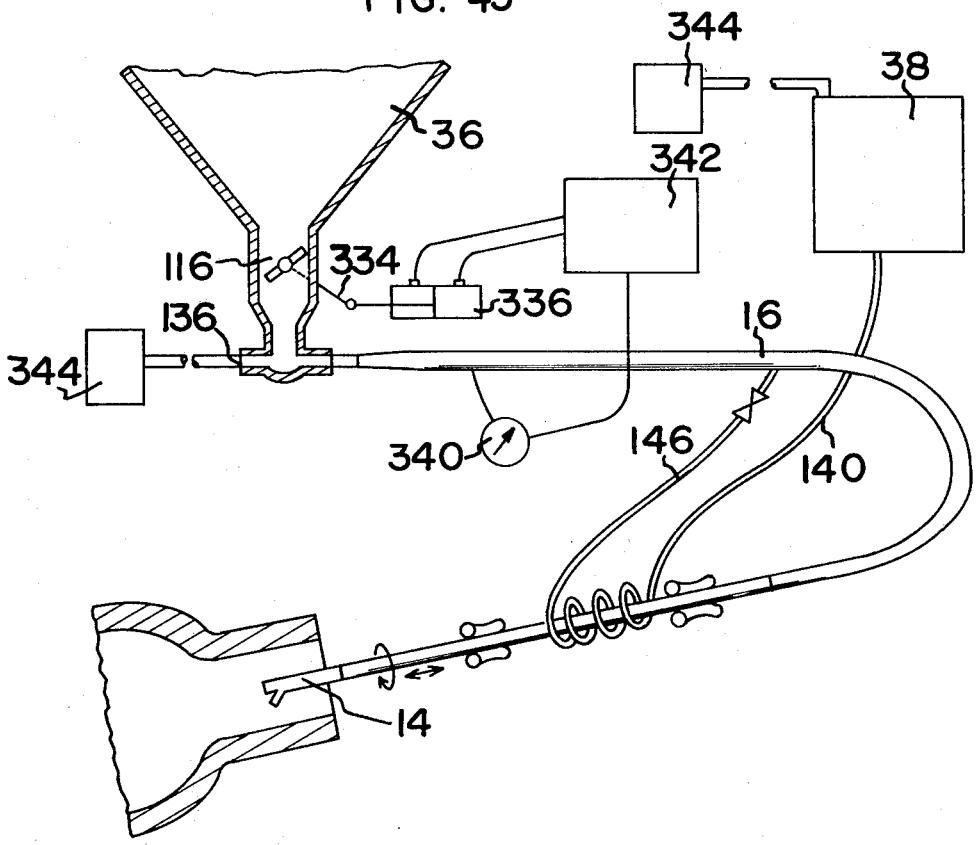
FIG. 45 is an illustrative view of the system for declogging the spray nozzle or spray pipe which is provided for the lining apparatus of a fifth embodiment.
Figure 46:
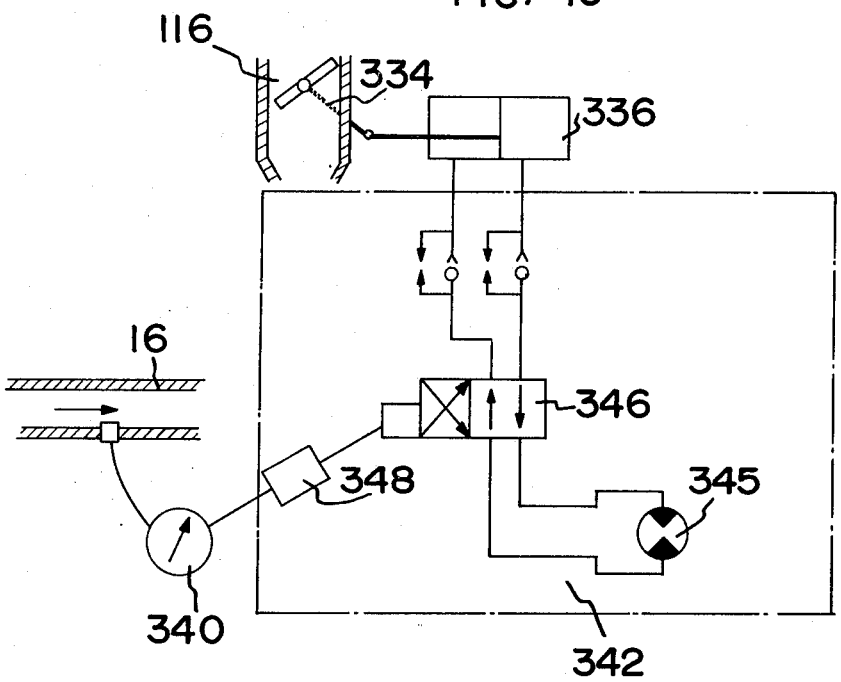
FIG. 46 is an enlarged explanatory view of regulating means which is employed in the above system for regulating the opening of the flow regulating valve.

The declogging system of this embodiment is constructed as shown in FIG. 45 and FIG. 46.

A connecting lever 334 has one end connected to the flow regulating valve 116 and the other end connected to a hydraulic cylinder 336.

A pressure gauge 340 is mounted at the middle of the flexible hose 16 which detects the supply pressure within the flexible hose 16.

Any unusually high pressure detected by the above gauge 340 is communicated to a regulating means 342 to regulate the actuation of the hydraulic cylinder 336.

An auxiliary air compressor 344 is also provided in the system which supplies the compressed air into the air gun 136 and the water storage tank 36.

The regulating means 342 is composed of a hydraulic pump 345, a solenoid valve 346 and a pressure-electricity converter 348 which converts a pressure signal to an electric signal.

In the above system, when the spray nozzle 14, the spray pipe 8 or the flexible hose 16 is clogged with refractory material, the pointer of the pressure gauge 340 shows an unusually high supply pressure. The thus detected pressure signal is converted into an electric signal by the converter 348 which accordingly energizes the solenoid valve 346.

When the solenoid valve 346 is energized, the actuating rod of the hydraulic cyliner 336 moves to close the flow regulating valve 116, the clogged portion becomes directly subject to the compressed air and compressed water whereby the clogging material is discharged along with the above two compressed flows from the spray nozzle 14 whereby the clogging is eliminated.

By eliminating the clogging, the supply pressure within the flexible hose 16 returns to a normal level and the pressure gauge 340 transmits the normal pressure signal to the converter 348 which converts the pressure signal to the electric signal. This electric signal energizes the solenoid valve 346 and the energization of the solenoid valve 346 actuates the hydraulic cylinder 336 such that the hydraulic cylinder 336 rotates the lever 334 in a direction to open the flow regulating valve 116. Accordingly the flow-regulating valve 116 resumes its normal operating position and refractory material in a desired amount is discharged into the flexible hose 16 thereafter.

Accordingly the system for adjusting the spraying operation automatically eliminates clogging of refractory material within the spray nozzle 14, spray pipe 8 or the flexible hose 16 without stopping the spraying operation.

SIXTH EMBODIMENT

This embodiment relates to the lining apparatus of this invention which is further provided with a system for regulating the amount of water to be mixed with the refractory material in a powder-like form.

In the lining operation which has been described heretofore, the refractory material in a wet-slurry form, which is produced by mixing the powder-like refractory material and water in a desired mixing is sprayed onto the furnace lining from the spray nozzle 14.

Especially when applying refractory material while the furnace is still hot, the spraying causes a drop in the temperature within the furnace. Therefore, the amount of water to be mixed with the powder-like refractory material must take into account the furnace temperature, since the adhering force and splash loss of the sprayed refractory material are greatly affected by the water percentage in the slurry-like refractory material and the temperature within the furnace.

Conventionally, adjustment of the quanity of water to be mixed with the refractory material is done by throttling a manually-operated valve disposed at the middle of the water supplying tube. Manual operation, however, cannot achieve the desired fine adjustment of water since it depends mainly on the experience of a skilled operator. Furthermore, due to the nature of the spraying operation, the manual throttling is subject to high radiation heat temperature from the furnace.

The afore-mentioned problems can be resolved by the system of this embodiment in such a manner that the amount of water to be mixed is adjusted in a digital way.

Figure 48:
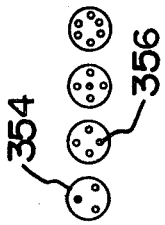
FIG. 48 is an explanatory view of orifice plates employed in the above water-regulating system.
Figure 47:
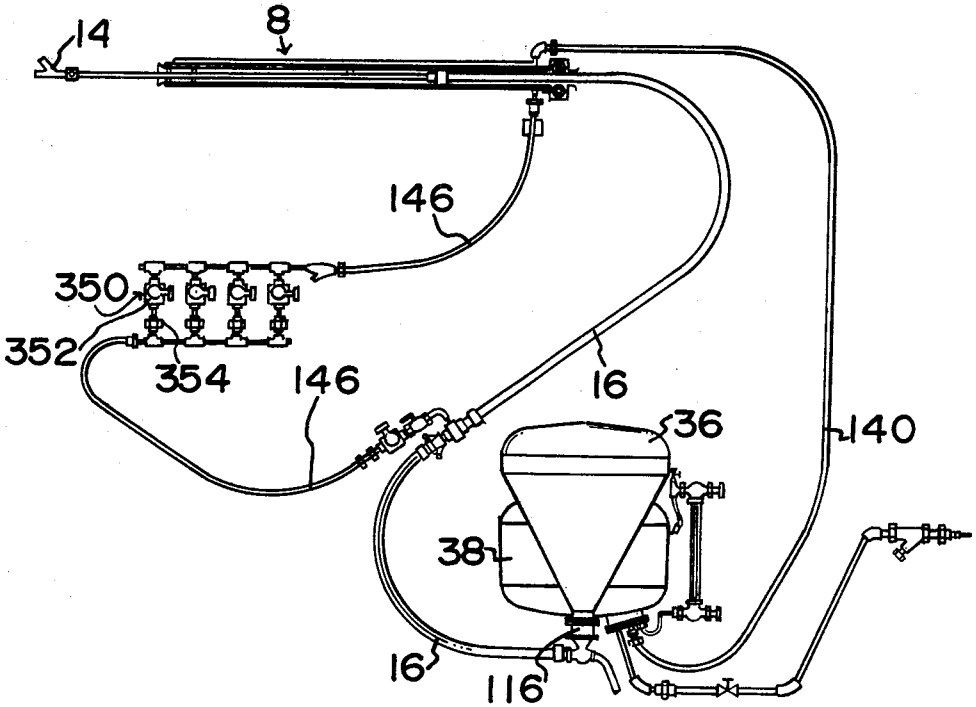
FIG. 47 is an illustrative view of the system for regulating the amount of water to be mixed with refractory material which is provided for the lining apparatus of a sixth embodiment.
Figure 49:
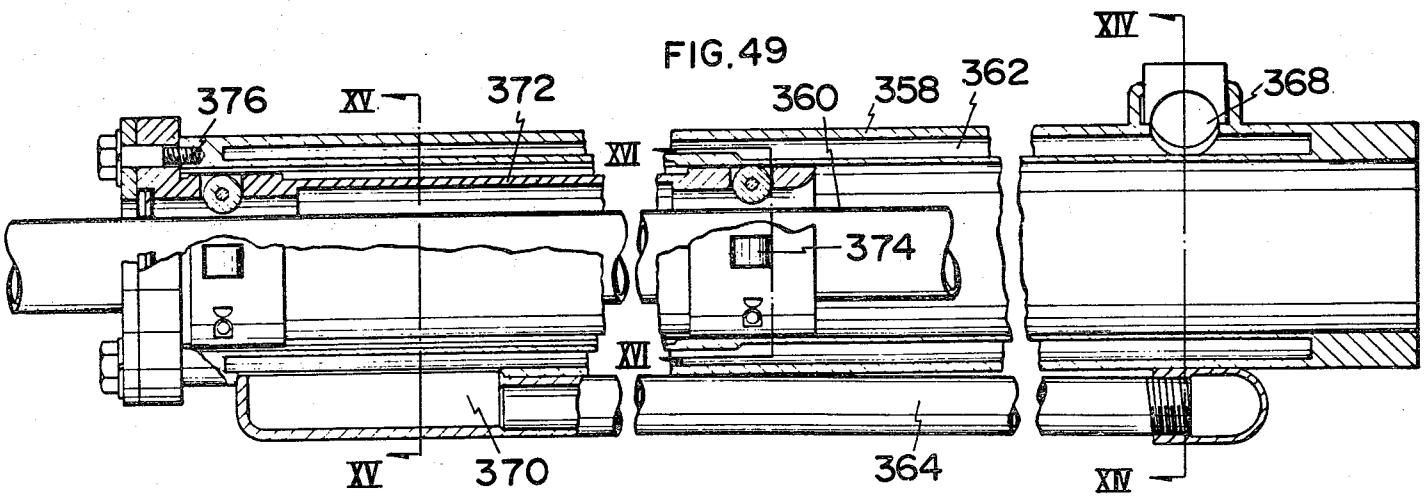
FIG. 49 is a longitudinal cross-sectional view of the spray pipe provided with a unique water cooling mechanism which is provided for the lining apparatus of a seventh embodiment of this invention.
Figure 52:
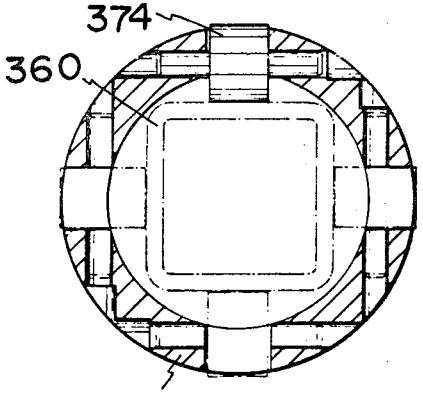
FIG. 52 is a transverse cross sectional view of the spray pipe taken along the line XVI—XVI of FIG. 49.
Figure 51:
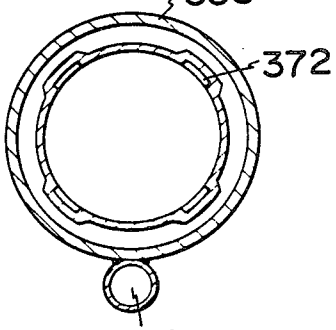
FIG. 51 is a transverse cross-sectional view of the spray pipe taken along the line XV—XV of FIG. 49.
Figure 50:
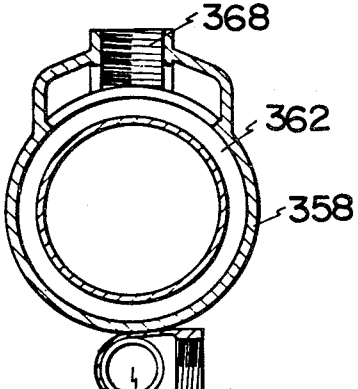
FIG. 50 is a transverse cross-sectional view of the spray pipe taken along the line XIV—XIV of FIG. 49.
Figure 53:
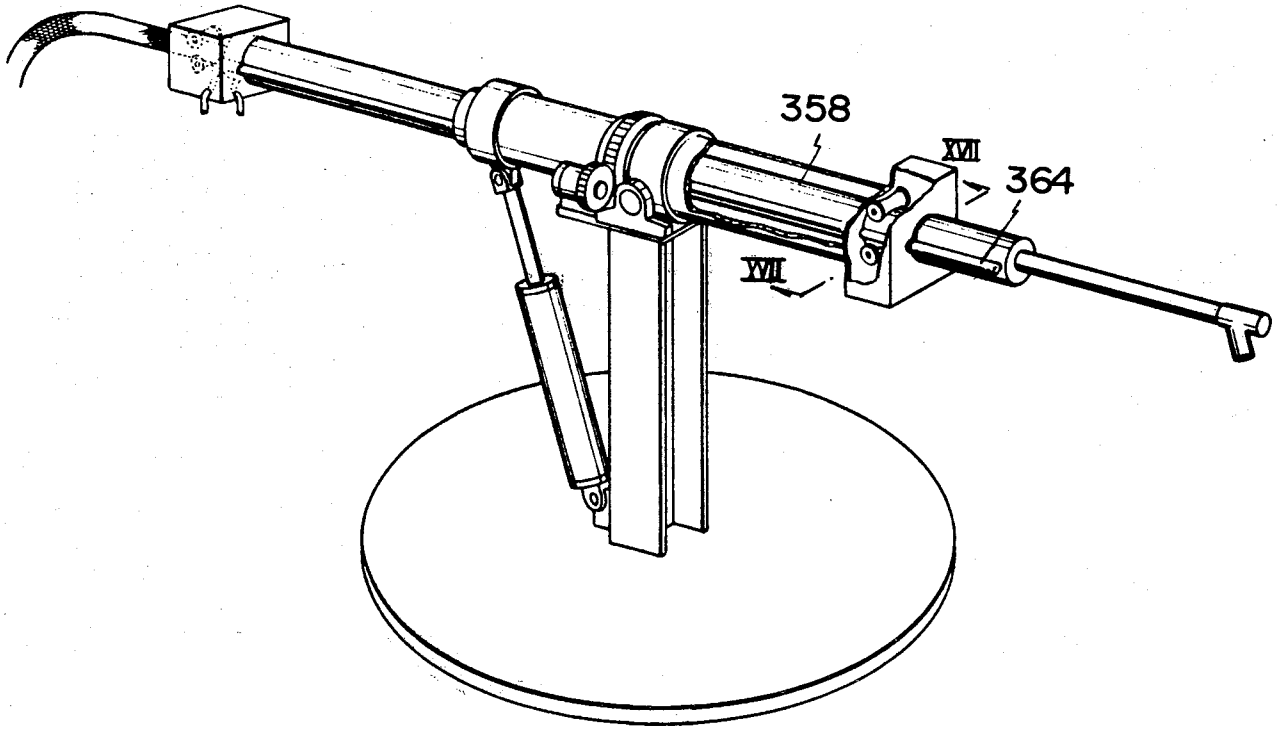
FIG. 53 is a schematic view of the simplified lining apparatus of this embodiment which is provided with the spray pipe.
Figure 54:
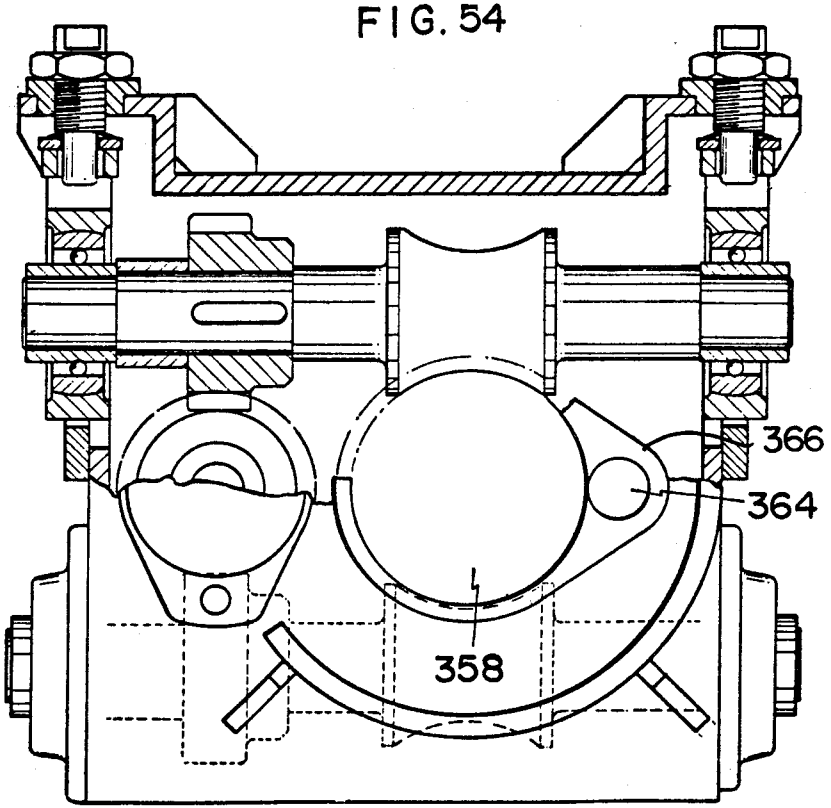
FIG. 54 is a transverse cross-sectional view of the spray pipe taken along the line XVII—XVII of FIG. 53.

The system of this invention has the following construction. In FIG. 47 and FIG. 48, a plurality or a desired number of communicating members 350 are parallely disposed in the middle of the warmed-water return tube 146, wherein each communicating member 350 is provided with a solenoid valve 352 and an orifice plate 354 having a different number of orifices 356 formed therethrough respectively.

The total flow area of each orifice plate 354 is the multiplication of the flow area of each orifice 356 and the number of orifices 356.

In this embodiment, an operator selects the desired combination of orifice plates 354 such that the total flow area of those orifice plates 354 are opened by energizing the corresponding solenoid valves 352 whereby a desired amount of warmed water is supplied into the flexible hose 16.

In FIG. 48, as an example, four orifice plates 354 are shown wherein the number of orifices are chosen in the ratio 3:4:5:6. Due to the above selection of orifice numbers, more than 10 combinations can be made in view of the numbers of orifices 356 (from 3 orifices to 18 orifices) which enables the amount of warmed water to be supplied along the warmed water return tube 146 to be regulated within a wide range automatically and with great accuracy. If the rough adjustment is permissible or if the number of communicating members 150 can be increased considerably, the number of orifices formed in the orifice plates may be equal or each orifice plate may have orifices of the same diameter.

Furthermore, if desired, a slide plate which has the desired number of orifices formed thereon can be disposed in the middle of the warmed water supply tube 146 wherein the amount of warmed water to be supplied to the flexible hose 16 is regulated by the transverse slide movement of the slide plate.

In short, the amount of water to be supplied to the flexible hose is digitally regulated automatically by selecting a desired combination of orifice plates whereby the accurate regulation of the water is achieved and the regulating operation is simply and easily conducted. Of course, the method of this embodiment is applicable not only to the warm water return tube as shown in FIG. 47, but also to a water supply line which carries water from the water storage tank to any desired location of the powder like refractory material supply line (e.g. flexible hose, spray pipe or spray nozzle).

SEVENTH EMBODIMENT

This embodiment relates to the lining apparatus of this invention which is further provided with a unique cooling system which efficiently cools the spray pipe which is subjected to high radiation heat during the spraying operation.

In the previous embodiments, spray pipe 8 has a double pipe construction wherein the inner pipe 10 passes through the outer pipe 12 and the refractory material flows through the inner pipe 10.

For facilitating water cooling, a water circulating chamber is formed within the wall of the outer spray pipe 12 and the chamber is divided by longitudinal partition plates into a supply chamber and a return chamber.

Furthermore, apart from the above water cooling means, the spray pipes 10 and 12 must be provided with a guide key and a key way thereon for regulating the sliding movement thereof relative to the outer cylindrical body 18.

Since spray pipe 8 has a rather complicated construction, its manufacture is difficult and accordingly, time- and labor- consuming.

This embodiment provides a spray pipe cooling system which assures its easy and inexpensive manufacture. Such cooling system is shown in FIG. 49 through FIG. 54 and has the following construction.

An outer spray pipe 358 is partially or entirely of double wall construction wherein the inner passage thereof works as a passage for sliding an inner spray pipe 360 therethrough and the outer passage thereof works as a cooling water supply chamber 362 into which the cooling water is supplied. A cooling water supply pipe 364 is secured to the outer periphery of the outer spray pipe 358 in parallel relation therewith. This cooling water supply pipe 364 has one end connected to the cooling water supply chamber 362 and the outer end connected to the cooling water supply tube 146. The supply pipe 364 also works as an elongated guide for the slide movement of the spray pipe 358 relative to the cylindrical body 18.

In the drawings, the outer spray pipe 358 is provided with a water outlet 368 and a water inlet 370 at respective ends thereof. For facilitating the smooth movement of the inner spray pipe 360 relative to the outer spray pipe 358, an intermediate cylindrical sleeve 372 is fixedly secured along and within the outer spray pipe 358 such that roller means 374 disposed equidistantly at both ends of the intermediate sleeve 372 impart the smooth movement of the inner spray pipe 360 relative to the intermediate sleeve 372. Numeral 376 indicates a scraper ring which prevents the intrusion of dust and other foreign materials into the space between the intermediate sleeve 372 and the inner spray pipe 360. This scraper ring also works as a heat insulating means.

In this embodiment, due to the specific construction of the spray pipe wherein the outer spray pipe 358 of double construction is provided with the water supply chamber 362 therebetween and the water supply pipe 364 is secured to the outside periphery of the outer spray pipe 358, the water supply chamber 362 has following effects; (a) it prevents the transfer of radiation heat from the furnace into inner spray pipe 360, (b) it cools off the outer spray pipe 358 itself so that the outer spray pipe 358 does not become deformed and remains rigid and (c) it also cools off the inner spray pipe 360 so that a rise in temperature of the inner spray pipe can be avoided.

Furthermore, since the warmed water which is provided by and after cooling the spray pipe is discharged into the warmed water return tube 146 by way of the water outlet 368, the formation of the partition plates within the water supply chamber 362 becomes no longer necessary whereby the spray pipe can be produced easily and at a reasonable cost. As previously mentioned, this return tube 364 also works as a guide for the slide movement and the rotation of spray pipe 358 relative to the cylindrical body 18.

EIGHTH EMBODIMENT

This embodiment relates to the lining apparatus of this invention which is further provided with a means to impart oscillation to the rotation of the spray pipe.

Figure 55:
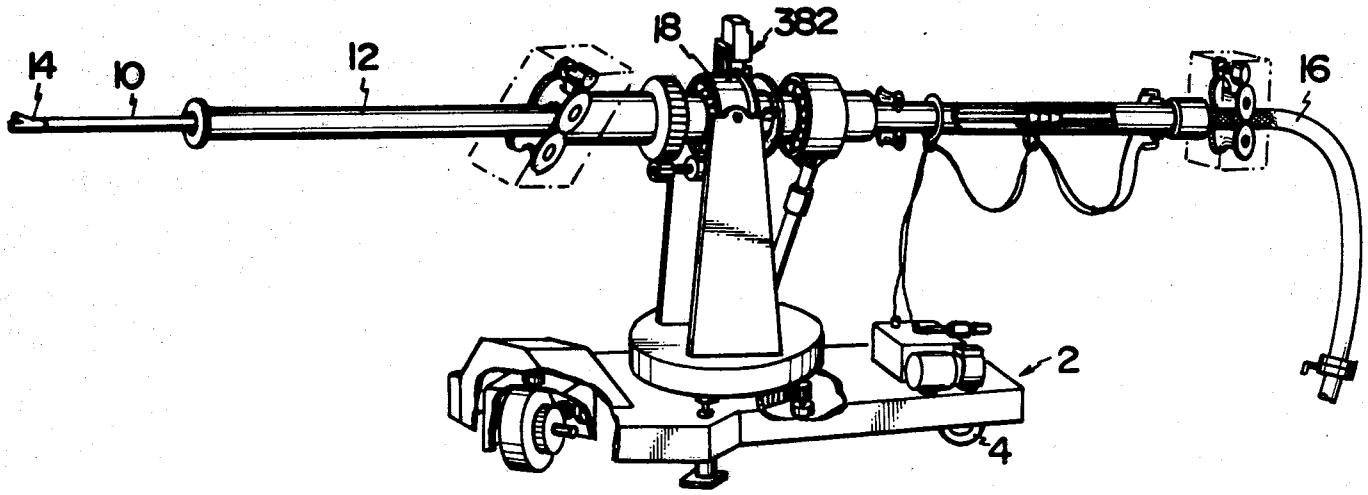
FIG. 55 is a schematic view of the simplified lining apparatus of an eighth embodiment of this invention which is provided with a means for imparting oscillation to the rotation of the outer spray pipe.

FIG. 55 shows the lining apparatus of this embodiment wherein the parts or devices which are irrelevant to the construction or manner of operation of the oscillating means are omitted for the purpose of simplifying the explanation.

Figure 56:
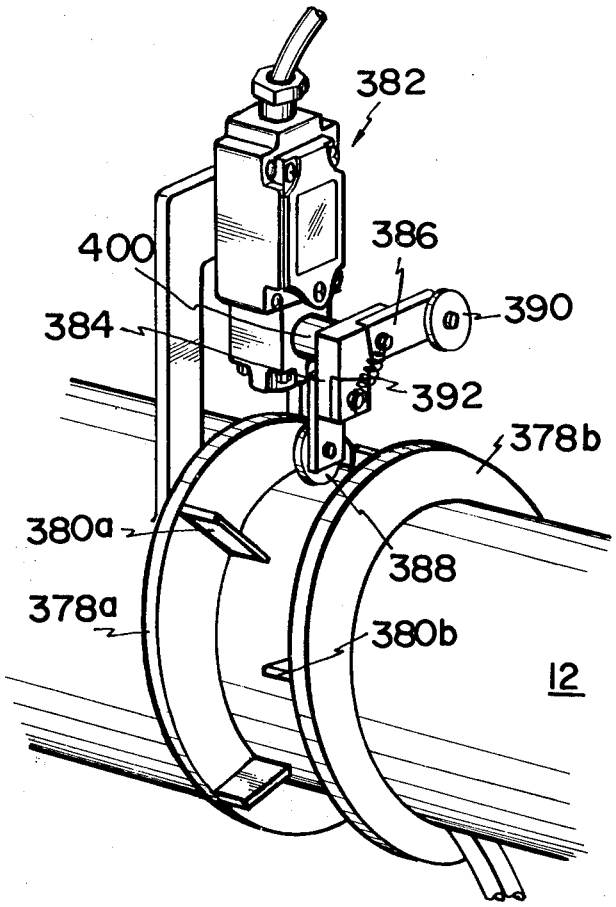
FIG. 56 is an enlarged explanatory view showing the mounting position of the oscillating means on the cylindrical body.
Figure 58:
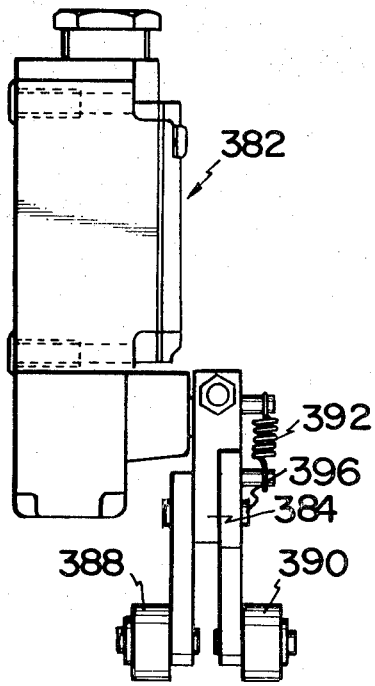
FIG. 58 is a side view of the above limit switch but showing one of the arms in a different position.
Figure 57:
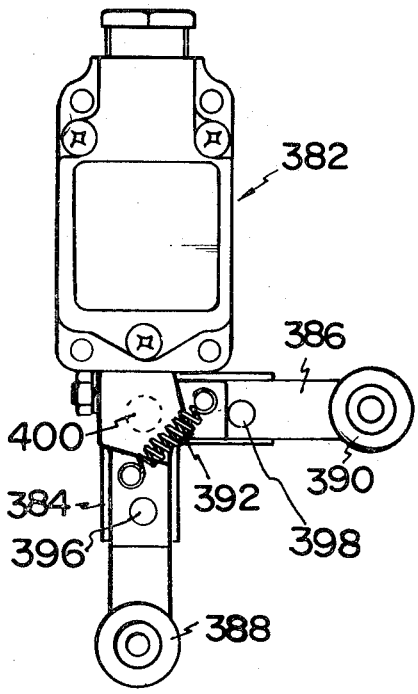
FIG. 57 is a front view of a limit switch employed in the above oscillating means.
Figure 59:
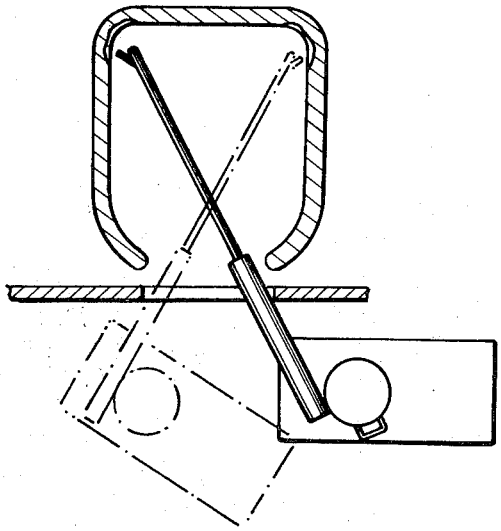
FIG. 59 is an explanatory view showing the lining apparatus in two operating positions.

The construction of the oscillating means is now described hereinafter in conjunction with FIG. 55 through FIG. 58, especially FIG. 56 which shows the detail thereof.

In the drawings, two spaced-apart circular ring plates **378*a* and 378*b* are formed onto the outer shooting pipe 12 adjacent to the pivot pin 41 which tiltably connects the cylindrical body 18 to the support column 24. Each ring plate 378*a* or 378*b* has a plurality of contacting pads 380*a* or 380*b* secured equidistantly circumferentially on the sides thereof which faces the corresponding side of the other ring plate. A fork-lever-shaped limit switch 382 which is provided with two pressure detecting levers 384, 386 is fixedly mounted on the top of the cylindrical body 18 such that one detecting lever 384 is disposed in the rotational path of the row of contacting pads 380*a* while detecting lever 386 is disposed in the rotational path of the row of connecting pads 380*b***.

The limit switch 382 which is especially applicable to the oscillating means of this embodiment further comprises contact rollers 388 and 390 attached to respective ends of the levers 384 and 386 and spring means 392 which tends to position the levers 384 and 386 in alignment with the body of the limit switch 382 unless no contact pressure is applied to the contact rollers 388 and 390.

In this embodiment, when the outer shooting pipe 12 is rotated relative to the cylindrical body 18 by the actuation of the motor 20 and gear mechanism 22, the contacting pad **380*a* disposed on the side of one ring plate 378*a* comes into contact with the corresponding contact roller 388 of the limit switch and subsequently rotates the pressure detecting lever 384. When the lever 384 is rotated 90°, the limit switch 382 initiates the rotation of the outer spray pipe 12** in the reverse direction.

The continued reverse rotation then causes the contacting pad **380*b* on the side of ring 378*b* to contact with the corresponding contact roller 390 of the limit switch 382, and subsequently the limit switch 382 stops the reverse rotation after rotating the lever 386 by 90° and starts the rotation of the outer cylindrical body 12** in the previous or first direction.

In this manner, the shooting pipe is oscillated periodically by a predetermined rotating or oscillating angle.

In FIG. 55, the spray nozzle 14 which has its opening directed in an upward direction is oscillated a desired angle for applying the refractory material onto the inner upper portion of the furnace lining uniformly.

However it must be noted that the oscillating device of this embodiment provides the above oscillating movement of the shooting pipe regardless of the direction of the spraying opening of the spray nozzle.

Namely, when the inner lower portion of the furnace lining is required to be repaired, the spray nozzle must be directed from the upward position to the lower position.

In this case, the supply of electricity to the limit switch 382 is interrupted so as not to energize the limit switch 382 even when its contact roller come into contact with the contact pad by the rotation of the outer spray pipe 12. For facilitating the above rotation of the outer shooting pipe 12 and also for preventing the breaking of the limit switch 382, the limit switch 382 is provided with two auxiliary pivot shafts 396 and 398 and a common shaft 400 which pivotally connects corresponding proximal ends of the two right-angled levers 384 and 386.

Each auxiliary pivot shaft is constructed such that it allows only one-way pivoting of the pressure detecting lever.

Due to the above construction, even when the vertically disposed contact roller of the inoperative limit switch 382 is pressed rearwardly by the trains of contacting pads **380*a* on one side of the ring-like plate 378, the outer spray pipe 12 is rotated without breaking the lever 384 since the rotation of the lever 384 on the auxiliary shaft 396** allows the advancement of above contacting pads.

Accordingly, since the spray pipe of this embodiment is capable of oscillating in addition to rotating, tilting and sliding, the spraying operation by the lining apparatus of this invention is further enhanced.

What we claim is:

1. An apparatus for applying a refractory material onto the inner surface of a furnace comprising in combination:

a mobile transport car;

a rotatable turntable mounted on said transport car;

a spray pipe having a spray nozzle at one end thereof for spraying refractory material onto the inner surface of a furnace and adapted to receive the refractory material from a supply of the refractory material adjacent the other end thereof, said spray pipe comprising inner and outer pipes;

support means positioned on said rotatably turntable rotatably and pivotably supporting said spray pipe;

storage means mounted on said rotatable turntable for storing at least a supply of refractory material therein, said storage means including a first tank for the storage of refractory material and a second tank for the storage of water which is concentrically disposed relative to said refractory material storage tank, and means carried by said transport car for supplying the refractory material to said spray pipe from said storage means and for propelling the refractory material through said spray pipe and spray nozzle.

2. Apparatus according to claim 1, wherein said outer pipe includes a pipe cooling means which comprises an inlet opening formed in the wall of said outer pipe and a cooling water supply tube connected between said water storage tank and said inlet opening in said outer pipe.

3. Apparatus according to claim 2, wherein a water outlet is formed in said outer pipe and a warm water return tube is connected between the water outlet of said outer pipe and the middle of a flexible hose.

4. Apparatus according to claim 1 wherein said refractory material supply means is a flexible hose connected between the other end of said spray pipe and said refractory material storage tank, said flexible hose being connected at said other end of said spray pipe to said inner pipe.

5. Apparatus according to claim 4, wherein said refractory supply means includes hose supporting means which comprises a hose-supporting hanger adapted to slidably support said flexible hose in the air relative to the extremity of the inner pipe to which said flexible hose is connected.

6. Apparatus according to claim 4, wherein said refractory material supply means includes an air jet gun which is disposed at the end of said flexible hose remote from its connection with said spray pipe for providing a propelling force.

7. Apparatus according to claim 6, wherein an air compressor is mounted on said transport car for supplying compressed air to said refractory material storage means and said air jet gun.

8. Apparatus according to claim 1, wherein said support means includes a vertical support structure surmounted by a cylindrical member pivotably carried thereon, said spray pipe being slidable and rotatably disposed within said cylindrical member.

9. Apparatus according to claim 8, including spray pipe control means which comprises:

tilting means for tilting said spray pipe on a pivot joint which pivotally connects said cylindrical member to said support structure, rotating means for rotating said outer pipe relative to said cylindrical member, pipe-propelling means for imparting longitudinal movement to said outer spray pipe relative to said cylindrical member and, another pipe-propelling means for imparting longitudinal movement to said inner spray pipe relative to said outer spray pipe.

10. Apparatus according to claim 9, wherein said spray pipe control means further includes means for oscillating the rotation of said spray pipe relative to said cylindrical member.

11. Apparatus according to claim 10, wherein said oscillating means comprises:

first and second spaced apart ring-like plates mounted on said outer pipe adjacent to one end of said cylindrical member, a selected number of circumferentially equidistant contact pads secured to the outer circular surface of said first ring-like plate which faces the corresponding surface of said second ring-like plate, said corresponding surface of said second plate also having a selected number of contact pads secured thereto, and a limit switch provided with two contact levers mounted on said cylindrical member, each of which levers is adapted to contact the contact pads of one of said ring-like plates so as to switch on and off said limit switch and thereby effect the rotation of said outer pipe relative to said cylindrical body in alternately opposed directions.

12. Apparatus according to claim 9, wherein said spray pipe control means further includes means for oscillating the rotation of said spray pipe relative to said cylindrical member by way of a rotating boom which forms a part of said cylindrical member, said boom slidably and non-rotatably encasing said spray pipe.

13. Apparatus according to claim 12, wherein said oscillating means comprises:

first and second spaced apart ring-like plates mounted on said rotating boom adjacent to one end of said cylindrical member, a selected number of circumferentially equidistant contact pads secured to the outer circular surface of said first ring-like plate which faces the corresponding surface of said second ringlike plate, said corresponding surface of said second ring-like plate also having a selected number of contact pads secured thereto, a limit switch provided with two contact levers mounted on said cylindrical member, each of said levers being adapted to contact the contact pads of one of said ring-like plates so as to switch said limit switch on and off and thereby effect the rotation of said outer pipe relative to said cylindrical member by way of said cylindrical member in alternately opposed directions.

14. Apparatus according to claim 1, including spray pipe control means for controlling the movement of said spray pipe.

15. Apparatus according to claim 1, wherein said storage means includes a refractory material storage tank, agitating means positioned rotatable therein adapted to prevent the formation of refractory material bridges within said tank thereby facilitating the discharge of refractory material out of said tank.

16. Apparatus according to claim 1, wherein said refractory material storage tank includes a lid which is movable horizontally to open or close a charging inlet of said storage tank.

17. Apparatus according to claim 1, wherein a discharge outlet is formed in said refractory material storage tank, said outlet having a flow regulating valve therein, said flow regulating valve including a throttle plate mounted pivotably across the opening of said outlet, a lever operably connected between said throttle plate and reciprocable valve actuating means, and spring means for absorbing excessive torque applied by said reciprocable means to said lever.

18. Apparatus according to claim 17, wherein said throttle valve is carried by a rotatable shaft, one end of said lever being fixedly secured to said shaft, a pivotable sleeve being provided and having a hydraulically driven reciprocable rod slidable positioned therein, the other end of said lever being pivotable secured to said pivotable sleeve, said rod being connected at one end thereof to a hydraulic cylinder and the other end thereof carrying a stop member, said spring means being mounted on said rod between said stop member and the end of said sleeve closest thereto.

19. Apparatus according to claim 1, wherein a discharge outlet is formed in said refractory material storage means and a flow regulating valve is positioned in said outlet, said flow regulating valve including a throttle plate mounted pivotably across the opening of said outlet.

20. Apparatus according to claim 19, wherein declogging means is provided for controlling said flow regulating valve in response to predetermined changes in flow pressure within said refractory material storage means.

21. Apparatus according to claim 20, wherein said declogging means comprises:

a pressure gauge for detecting the flow pressure within said refractory storage means, a pressure-electricity converter adapted to convert a pressure signal from said pressure gauge into an electrical signal, and a solenoid valve and hydraulic linear actuator operatively connected thereto, said actuator being operatively connected to said throttle plate, whereby application of the electric signal to said solenoid valve serves to actuate said actuator and control the movement of said throttle plate.

22. An apparatus for applying a refractory material onto the inner surface of a furnace comprising in combination:

a mobile transport car;

a rotatable turntable mounted on said transport car;

a spray pipe having a spray nozzle at one end thereof for spraying refractory material onto the inner surface of a furnace and adapted to receive the refractory material from a supply of the refractory material adjacent the other end thereof;

support means positioned on said rotatable turntable rotatably and pivotably supporting said spray pipe;

storage means mounted on said rotatable turntable for storing at least a supply of refractory material therein, said storage means including a refractory material storage tank and agitating means positioned rotatably therein and adapted to prevent the formation of refractory material bridges within said tank, thereby facilitating the discharge of refractory material out of said tank;

said refractory material storage tank further including means for measuring the amount of refractory material therein, a resistance structure mounted on said agitating means immersible at least partially in the refractory material and thus rotatable against the flow resistance of refractory material within said tank when said agitating means is rotated, and a measuring device adapted to provide a visual indication of refractory material within said tank in response to a signal generated by said resistance structure; and means carried by said transport car for supplying the refractory material to said spray pipe from said storage means and for propelling the refractory material through said spray pipe and spray nozzle.

23. An apparatus for applying a refractory material onto the inner surface of a furnace comprising in combination:

a mobile transport car;

a rotatably turntable mounted on said transport car;

a spray pipe having a spray nozzle at one end thereof for spraying refractory material onto the inner surface of a furnace and adapted to receive the refractory material from a supply of the refractory material adjacent the other end thereof;

support means positioned on said rotatable turntable rotatably and pivotably supporting said spray pipe;

storage means mounted on said rotatable turntable for storing at least a supply of refractory material therein;

means carried by said transport car for supplying the refractory material to said spray pipe from said storage means and for propelling the refractory material through said spray pipe and spray nozzle; and first, second and third measuring means, the first of said measuring means comprising an arcuate scale plate having the radial center thereof coincident with the vertical axis of said turntable and an index marker on said storage means in alignment with the vertical axis of said turntable; said first measuring means being thus adapted to measure the horizontal rotational angle of said turntable, said second measuring means comprising an arcuate scale plate mounted vertically on said storage means and an index marker cooperable therewith for measuring the vertical angle through which said spray pipe has been pivoted, and said third measuring means comprising a linear scale carried by said refractory material supply means for measuring the linear movement of said spray pipe.

24. An apparatus for applying a refractory material onto the inner surface of a furnace comprising in combination:

a mobile transport car;

a rotatable turntable mounted on said transport car;

a spray pipe having a spray nozzle at one end thereof for spraying refractory material onto the inner surface of a furnace and adapted to receive the refractory material from a supply of the refractory material adjacent the other end thereof, said spray pipe comprising inner and outer pipes;

support means positioned on said rotatable turntable rotatably and pivotably supporting said spray pipe;

storage means mounted on said rotatable turntable for storing at least a supply of refractory material therein, said storage means comprising a first tank for the storage of refractory material and a second tank for storage of water;

said outer pipe including a pipe cooling means which comprises an inlet opening formed in the wall of said outer pipe and a cooling water supply tube connected between said water storage tank and said inlet opening in said outer pipe;

means carried by said transport car for supplying the refractory material to said spray pipe from said storage means and for propelling the refractory material through said spray pipe and spray nozzle, said refractory material supply means comprising a flexible hose connected between the other end of said spray pipe and said refractory material storage tank, said flexible hose being connected at said other end of said spray pipe to said inner pipe;

a water outlet formed in said outer pipe and a warm water return tube connected between the water outlet of said outer pipe and the middle of said flexible hose; and a selected number of water-regulating means each of which includes an orifice plate provided with a plurality of orifices formed therein, said water-regulating means being disposed in parallel relation at an intermediate location in said warm water return tubes, and each of said water-regulating means including a solenoid valve adapted to selectively control the flow of water through the associated orifice plate.

25. Apparatus according to claim 24, wherein each of said orifice plates is given a different number of orifices.

26. An apparatus for applying a refractory material onto the inner surface of a furnace comprising in combination:

a mobile transport car;

a rotatable turntable mounted on said transport car;

a spray pipe having a spray nozzle at one end thereof for spraying refractory material onto the inner surface of a furnace and adapted to receive the refractory material from a supply of the refractory material adjacent the other end thereof, said spray pipe comprising inner and outer pipes;

support means positioned on said rotatable turntable rotatable and pivotably supporting said spray pipe;

storage means mounted on said rotatable turntable for storing at least a supply of refractory material therein, said storage means comprising a first tank for the storage of refractory material and a second tank for the storage of water;

said outer pipe including a pipe cooling means which comprises an inlet opening formed in the wall of said outer pipe and a cooling water supply tube connected between said water storage tank and said inlet opening in said outer pipe;

means carried by said transport car for supplying the refractory material to said spray pipe from said storage means and for propelling the refractory material through said spray pipe and spray nozzle, said refractory material supply means comprising a flexible hose connected between the other end of said spray pipe and said refractory material storage tank, said flexible hose being connected at said other end of said spray pipe to said inner pipe;

a water outlet formed in said outer pipe and a warm water return tube connected between the water outlet of said outer pipe and the middle of said flexible hose;

the space between said inner and outer pipes serving as a cooling water supply chamber, a cooling water return tube being secured externally to and in parallel relation with said outer pipe, said cooling water return tube being in communication at one end thereof with said cooling water supply chamber and at the other end thereof with said warm water return tube.

27. An apparatus for applying a refractory material onto the inner surface of a furnace comprising in combination:

a mobile transport car;

a rotatable turntable mounted on said transport car;

a spray pipe having a spray nozzle at one end thereeof for spraying refractory material onto the inner surface of a furnace and adapted to receive the refractory material from a supply of the refractory material adjacent the other end thereof;

support means positioned on said rotatable turntable rotatably and pivotably supporting said spray pipe, said support means including a vertical support column and a cylindrical member pivotably carried at the top thereof, an elongated bar being slidably positioned within said cylindrical member, first, second and third measuring devices being provided, said first measuring device comprising a circumferentially extending scale on said turntable for measuring the horizontal rotational angle thereof, said second measuring device comprising an arcuate scale carried by said turntable adjacent said cylindrical member for measuring the vertical angle through which said cylindrical member has been pivoted, and said third measuring device comprising a linear scale on said elongated bar for measuring the linear distance said bar is moved longitudinally of said cylindrical member;

storage means mounted on said rotatable turntable for storing at least a supply of refractory material therein; and means carried by said transport car for supplying the refractory material to said spray pipe from said storage means and for propelling the refractory material through said spray pipe and spray nozzle.

28. An apparatus for applying a refractory material onto the inner surface of a furnace comprising in combination:

a mobile transport car;

a rotatable turntable mounted on said transport car;

a spray pipe having a spray nozzle at one end thereof for spraying refractory material onto the inner surface of a furnace and adapted to receive the refractory material from a supply of the refractory material adjacent the other end thereof;

support means positioned on said rotatable turntable rotatably and pivotably supporting said spray pipe;

storage means mounted on said rotatable turntable for storing at least a supply of refractory material therein;

means carried by said transport car for supplying the refractory material to said spray pipe from said storage means and for propelling the refractory material through said spray pipe and spray nozzle;

and an operator's seat integrally mounted on said rotatable turntable, whereby said turntable, said spray pipe, said support means, said storage means and said operator's seat are all simultaneously and integrally rotatable.

* * * * *